US012788109B1

(12) United States Patent
Holt et al.

(10) Patent No.: US 12,788,109 B1
(45) Date of Patent: Nov. 10, 2026

(54) SOLE STRUCTURE FOR ARTICLE OF FOOTWEAR

(71) Applicant: NIKE, Inc., Beaverton, OR (US)

(72) Inventors: Scott C. Holt, Portland, OR (US); Roger Paul Murphy, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/298,603

(22) Filed: Aug. 13, 2025

Related U.S. Application Data

(63) Continuation of application No. 17/719,678, filed on Apr. 13, 2022, now Pat. No. 12,426,680.

(60) Provisional application No. 63/174,659, filed on Apr. 14, 2021.

(51) Int. Cl.
*A43B 13/20* (2006.01)
*A43B 13/18* (2006.01)

(52) U.S. Cl.
CPC ..... *A43B 13/20* (2013.01); *A43B 13/181* (2013.01)

(58) Field of Classification Search
CPC ..... A43B 13/188; A43B 13/186; A43B 13/20; A43B 13/122; A43B 13/125; A43B 13/181
See application file for complete search history.

(56) References Cited

U.S. PATENT DOCUMENTS

| | | | | |
|---|---|---|---|---|
| 5,595,004 | A | 1/1997 | Lyden et al. | |
| 6,354,020 | B1 | 3/2002 | Kimball et al. | |
| 9,144,264 | B2 | 9/2015 | Marvin et al. | |
| 10,034,517 | B2 * | 7/2018 | Christensen | A43B 13/189 |
| 10,070,691 | B2 | 9/2018 | Greene | |
| 10,645,996 | B2 | 5/2020 | Case et al. | |
| 11,517,074 | B2 | 12/2022 | VanDomelen | |
| 2009/0100705 | A1 * | 4/2009 | Cook | A43B 13/12 36/28 |
| 2012/0073160 | A1 | 3/2012 | Marvin et al. | |
| 2013/0167401 | A1 * | 7/2013 | Christensen | A43B 13/20 36/29 |
| 2014/0020264 | A1 * | 1/2014 | Holt | A43B 13/04 12/146 B |

(Continued)

FOREIGN PATENT DOCUMENTS

| | | | |
|---|---|---|---|
| WO | WO-200119211 | A1 | 3/2001 |
| WO | WO-2019118533 | A1 | 6/2019 |
| WO | WO-2019118540 | A1 | 6/2019 |

OTHER PUBLICATIONS

European Patent Office (ISA), International Search Report and Written Opinion of the International Searching Authority for PCT/US2022/024757 mailed Jul. 8, 2022.

(Continued)

*Primary Examiner* — Haley A Smith
(74) *Attorney, Agent, or Firm* — Honigman LLP; Matthew H. Szalach

(57) ABSTRACT

A sole structure for an article of footwear includes a chassis having a first side defining a footbed and a second side disposed on an opposite side from the first side, a first bladder attached to the second side of the chassis and including at least one first chamber defining a first polar axis oriented in a first direction, and a second bladder attached to second side of the chassis and including at least one second chamber defining a second polar axis oriented in a second direction transverse to the first direction.

20 Claims, 16 Drawing Sheets

(56) References Cited

U.S. PATENT DOCUMENTS

| | | | |
|---|---|---|---|
| 2016/0021974 | A1 | 1/2016 | Schindler et al. |
| 2016/0073732 | A1 | 3/2016 | Ernst et al. |
| 2020/0154826 | A1 | 5/2020 | Case et al. |

OTHER PUBLICATIONS

USPTO, Non-Final Office Action for U.S. Appl. No. 17/719,678, mailed Jul. 25, 2024.

* cited by examiner

SOLE STRUCTURE FOR ARTICLE OF FOOTWEAR

CROSS REFERENCE TO RELATED APPLICATIONS

This application is a continuation of U.S. Non-Provisional application Ser. No. 17/719,678, filed Apr. 13, 2022, which claims priority under 35 U.S.C. § 119(e) to U.S. Provisional Application Ser. No. 63/174,659, filed Apr. 14, 2021. The disclosures of these prior applications are considered part of the disclosure of this application and are hereby incorporated by reference in their entirety.

FIELD

The present disclosure relates generally to methods and systems for forming bladders for articles of footwear, and to sole structures incorporating bladders formed using the methods and systems.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
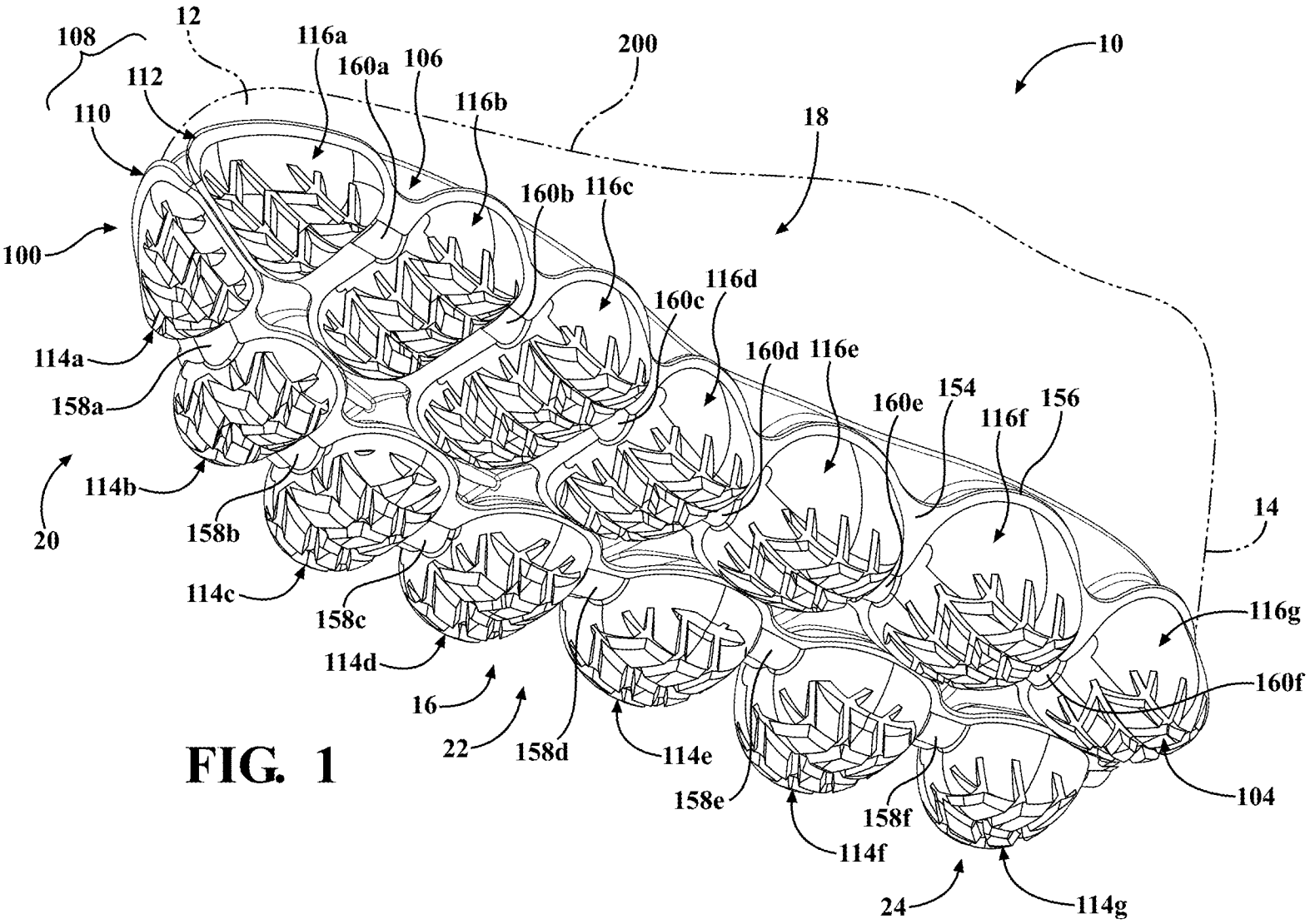
FIG. 1 is a bottom perspective view of an article of footwear including a sole structure formed according to the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear includes a chassis having a first side defining a footbed and a second side disposed on an opposite side from the first side, a first bladder attached to the second side of the chassis and including at least one first chamber defining a first polar axis oriented in a first direction, and a second bladder attached to second side of the chassis and including at least one second chamber defining a second polar axis oriented in a second direction transverse to the first direction.

The sole structure may include one or more of the following optional features. For example, the first direction may be a first oblique angle oriented towards a lateral side of the sole structure and the second direction may be a second oblique angle oriented towards a medial side of the sole structure. Additionally or alternatively, the at least one first chamber may be aligned with the at least one second chamber in a lateral direction of the sole structure and/or the at least one first chamber and the at least one second chamber may each have an ellipsoidal shape. Further, the ellipsoidal shape may be truncated.

At least one first chamber may include a plurality of first chambers arranged along a lateral side of the sole structure and the at least one second chamber may include a plurality of second chambers arranged along a medial side of the sole structure, each of the first chambers may be oriented in the first direction and each of the second chambers may be oriented in the second direction.

In one configuration, the second side of the chassis may include at least one first socket attached to the at least one first chamber and at least one second socket attached to the at least one second chamber. The at least one first socket may be oriented in the first direction and the at least one second socket may be oriented in the second direction. The at least one first socket may include a first receptacle configured to receive the at least one first chamber and the at least one second socket may include a second receptacle configured to receive the at least one second chamber. The first receptacle may define a first concave surface and the second receptacle may define a second concave surface.

In one configuration, the first bladder and the second bladder are a unitary piece. Alternatively, the first bladder and the second bladder are separate from one another.

In another configuration, a sole structure for an article of footwear includes a chassis having a top side defining a footbed and a bottom side disposed on an opposite side form the top side, a first bladder attached to the chassis at the bottom side and including at least one first chamber distended beyond the footbed on a first side of the sole structure, and a second bladder attached to the chassis at the bottom side and including at least one second chamber distended beyond the footbed on a second side of the sole structure.

The sole structure may include one or more of the following optional features. For example, the at least one first chamber may extend at a first oblique angle oriented towards the first side of the sole structure and the at least one second chamber may extend at a second oblique angle oriented towards the second side of the sole structure. The at least one first chamber may be aligned with the at least one second chamber in a lateral direction of the sole structure. Additionally or alternatively, the at least one first chamber and the at least one second chamber may each have an ellipsoidal shape. The ellipsoidal shape may be truncated.

In one configuration, the at least one first chamber may include a plurality of first chambers arranged along a lateral side of the sole structure and the at least one second chamber may include a plurality of second chambers arranged along a medial side of the sole structure, each of the first chambers may be oriented in a first direction and each of the second chambers may be oriented in a second direction.

The bottom side of the chassis may include at least one first socket attached to the at least one first chamber and at least one second socket attached to the at least one second chamber. The at least one first socket may be oriented towards the first side of the sole structure and the at least one second socket may be oriented towards the second side of the sole structure. Additionally or alternatively, the at least one first socket may include a first receptacle configured to receive the at least one first chamber and the second socket may include a second receptacle configured to receive the at least one second chamber. The first receptacle may define a first concave surface and the second receptacle may define a second concave surface.

In one configuration, the first bladder and the second bladder are a unitary piece. Alternatively, the first bladder and the second bladder are separate from one another.

In another configuration, a method of forming a sole structure for an article of footwear includes (i) inserting a barrier layer in a mold cavity of a mold assembly, the mold cavity defining at least one first chamber cavity oriented at a first angle and at least one second chamber cavity oriented at a second angle, (ii) biasing the barrier layer against a surface of the mold cavity to form a cushioning arrangement including at least one first chamber in the at least one first chamber cavity oriented at the first angle and at least one second chamber in the at least one second chamber cavity oriented at the second angle; (iii) extracting the cushioning arrangement from the mold cavity, (iv) rotating the first chamber in a first direction about a longitudinal axis of the cushioning arrangement to orient the first chamber at a third angle, and (v) rotating the second chamber in a second direction about the longitudinal axis to orient the second chamber at a fourth angle transverse to the third angle.

The method may include one or more of the following optional steps and features. For example, the method may include attaching the first chamber to a first socket of a chassis oriented at the third angle and/or attaching the second chamber to a second socket of the chassis oriented at the fourth angle. Orienting the at least one first chamber at the third angle may include positioning a lower portion of the at least one first chamber outwardly from an upper portion of the first chamber relative to a longitudinal axis of the sole structure. The at least one first chamber cavity may include a plurality of first chamber cavities and the at least one second chamber cavity may include a plurality of second chamber cavities.

In one configuration, biasing the barrier layer against the surface of the mold cavity may include providing a fluid to the plurality of first chamber cavities via a first inflation conduit and providing a fluid to the plurality of second chamber cavities via a second inflation conduit in parallel with the first inflation conduit. Additionally or alternatively, the method may include joining the barrier layers together at a first inflation port to seal the at least one first chamber and joining the barrier layers together at a second inflation port to seal the at least one second chamber in fluid isolation from the at least one first chamber.

The mold cavity may define a ridge disposed between the at least one first chamber cavity and the at least one second chamber cavity. The ridge may include a first ridge surface adjacent to the at least one first chamber cavity and a second ridge surface adjacent to the at least one second chamber cavity, the first ridge surface may be transverse to the second ridge surface. In one configuration, a width of the ridge may taper between the first chamber cavity and the second chamber cavity.

The method may additionally include forming a gap between the at least one first chamber and the at least one second chamber using the ridge, and bending the at least one first chamber towards the at least one second chamber to reduce a width of the gap.

A mold system for forming a cushioning arrangement for an article of footwear includes at least one first chamber cavity oriented at a first angle, at least one second chamber cavity oriented at a second angle transverse to the first angle, an inflation manifold including a first inflation conduit in fluid communication with the at least one first chamber cavity and a second inflation conduit in fluid communication with the at least one second chamber cavity.

The mold system may include one or more of the following optional features. For example, the at least one first chamber cavity may include a plurality of chamber cavities fluidly coupled along the first inflation conduit and the at least one second chamber cavity may include a plurality of second chamber cavities fluidly coupled along the second inflation conduit. The at least one first chamber cavity may have a first ellipsoidal shape defining a first axis oriented at the first angle and the at least one second chamber cavity may have a second ellipsoidal shape defining a second axis oriented at the second angle. At least one of the first ellipsoidal shape or the second ellipsoidal shape may include a truncated ellipsoidal shape.

In one configuration, a ridge may be disposed between the at least one first chamber cavity and the at least one second chamber cavity. The ridge may include a first ridge surface adjacent to the at least one first chamber cavity and a second ridge surface adjacent to the at least one second chamber cavity, the first ridge surface may be transverse to the second ridge surface. Additionally or alternatively, a width of the ridge may taper between the first chamber cavity and the second chamber cavity.

The details of one or more implementations of the disclosure are set forth in the accompanying drawings and the description below. Other aspects, features, and advantages will be apparent from the description and drawings, and from the claims.

Figure 5:
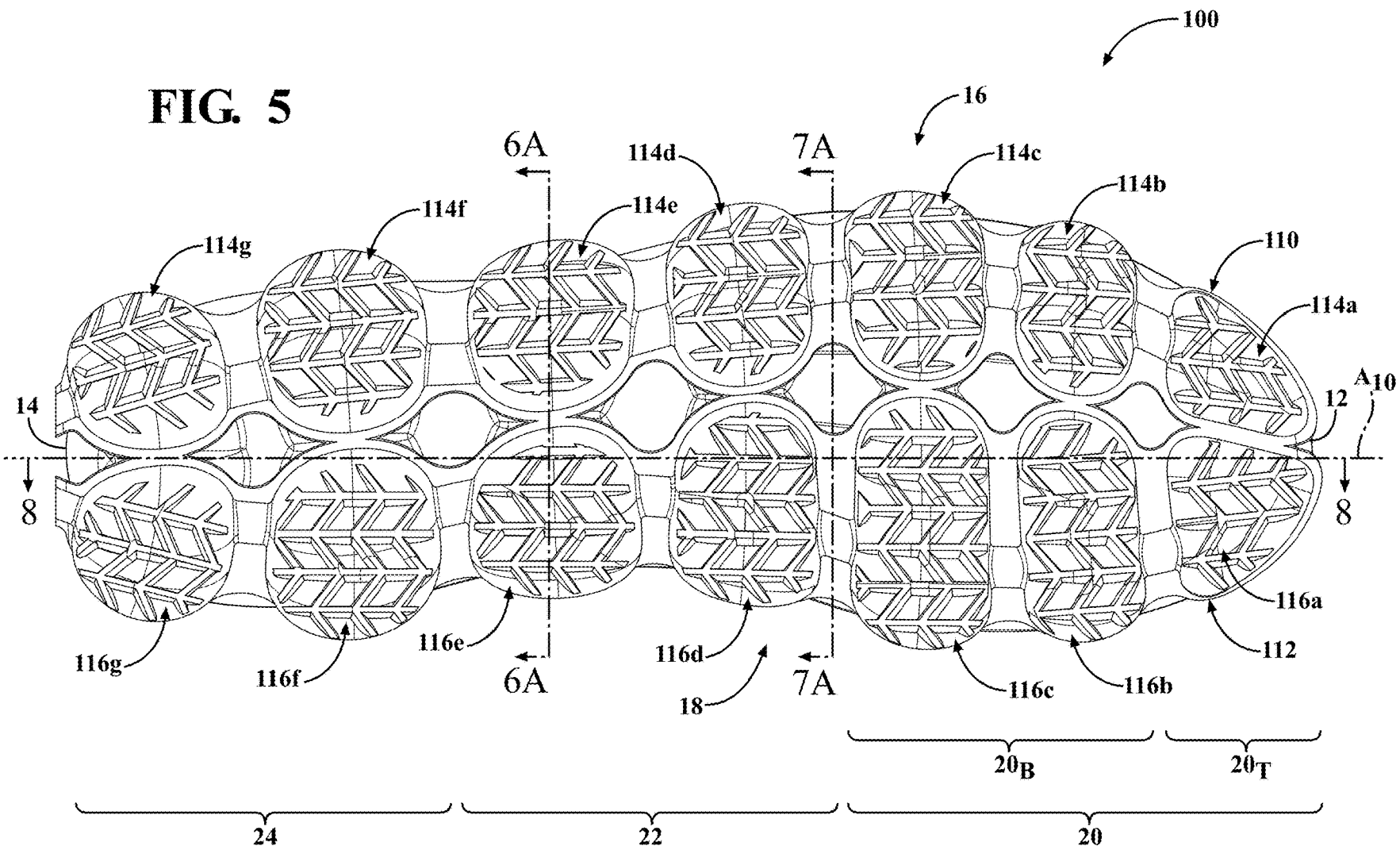
FIG. 5 is a bottom plan view of the sole structure of FIG. 1.
Figure 5A:
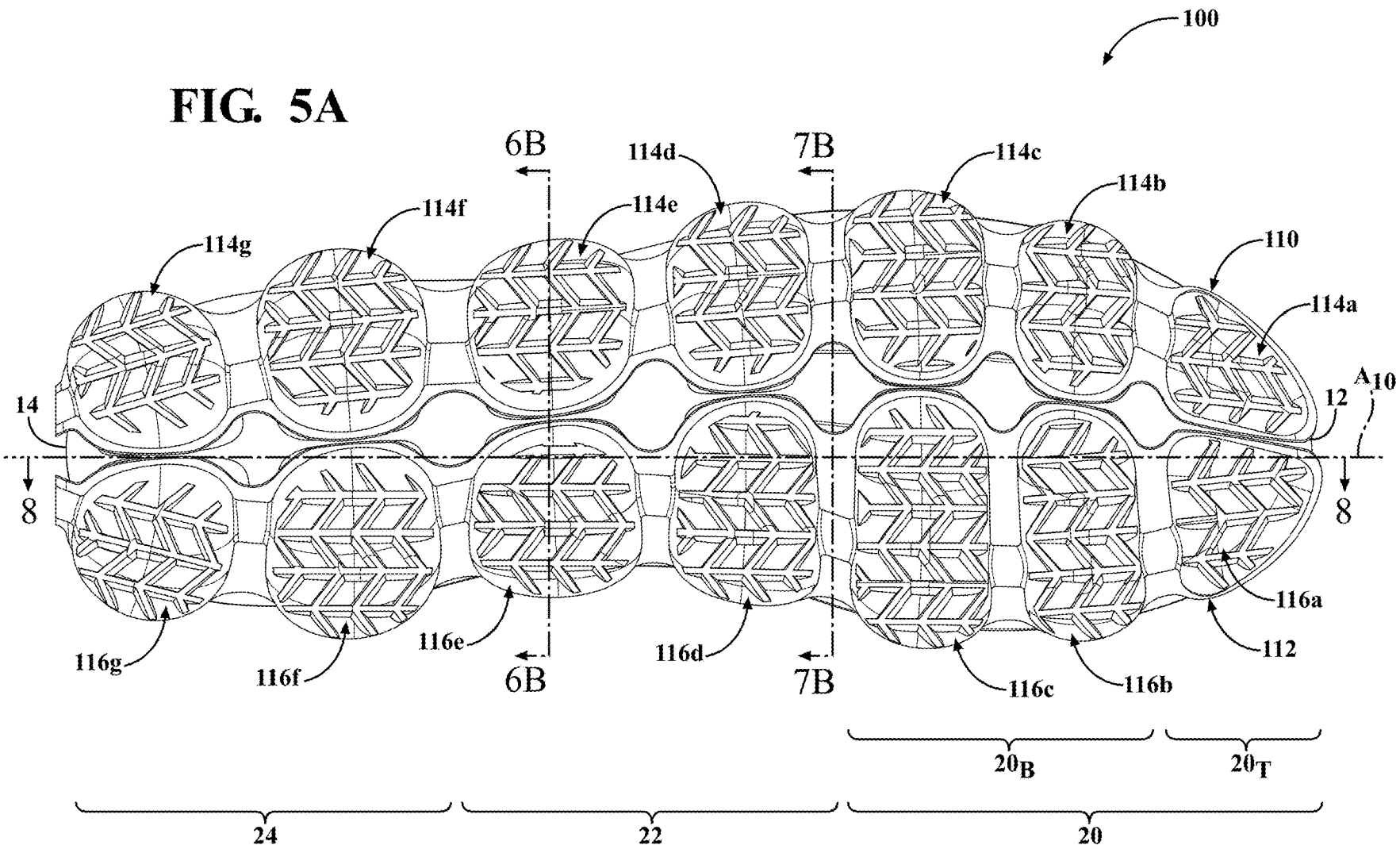
FIG. 5A is a bottom plan view of the sole structure of FIG. 1 showing the first bladder and the second bladder formed as separate pieces.

Referring to FIG. 1, an article of footwear 10 includes a sole structure 100 and an upper 200 attached to the sole structure 100. The footwear 10 may further include an anterior end 12 associated with a forward-most point of the footwear 10, and a posterior end 14 corresponding to a rearward-most point of the footwear 10. As shown in FIGS. 5 and 5A, a longitudinal axis $A_{10}$ of the footwear 10 extends along a length of the footwear 10 from the anterior end 12 to the posterior end 14 parallel to a ground contacting plane $P_{100}$ (shown in FIGS. 6A and 6B) defined by the sole structure 100, and generally divides the footwear 10 into a lateral side 16 and a medial side 18. Accordingly, the lateral side 16 and the medial side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the lateral side 16 to the medial side 18. Furthermore, a vertical direction refers to the direction extending from the ground-contacting plane $P_{100}$ towards the upper 200.

The article of footwear 10 may be divided into one or more regions. The regions may include a forefoot region 20, a mid-foot region 22, and a heel region 24. The forefoot region 20 may be subdivided into a toe portion $\mathbf{20}_T$ corresponding with phalanges and a ball portion $\mathbf{20}_B$ associated with metatarsal bones of a foot. The mid-foot region 22 may correspond with an arch area of the foot, and the heel region 24 may correspond with rear portions of the foot, including a calcaneus bone.

Figure 2:
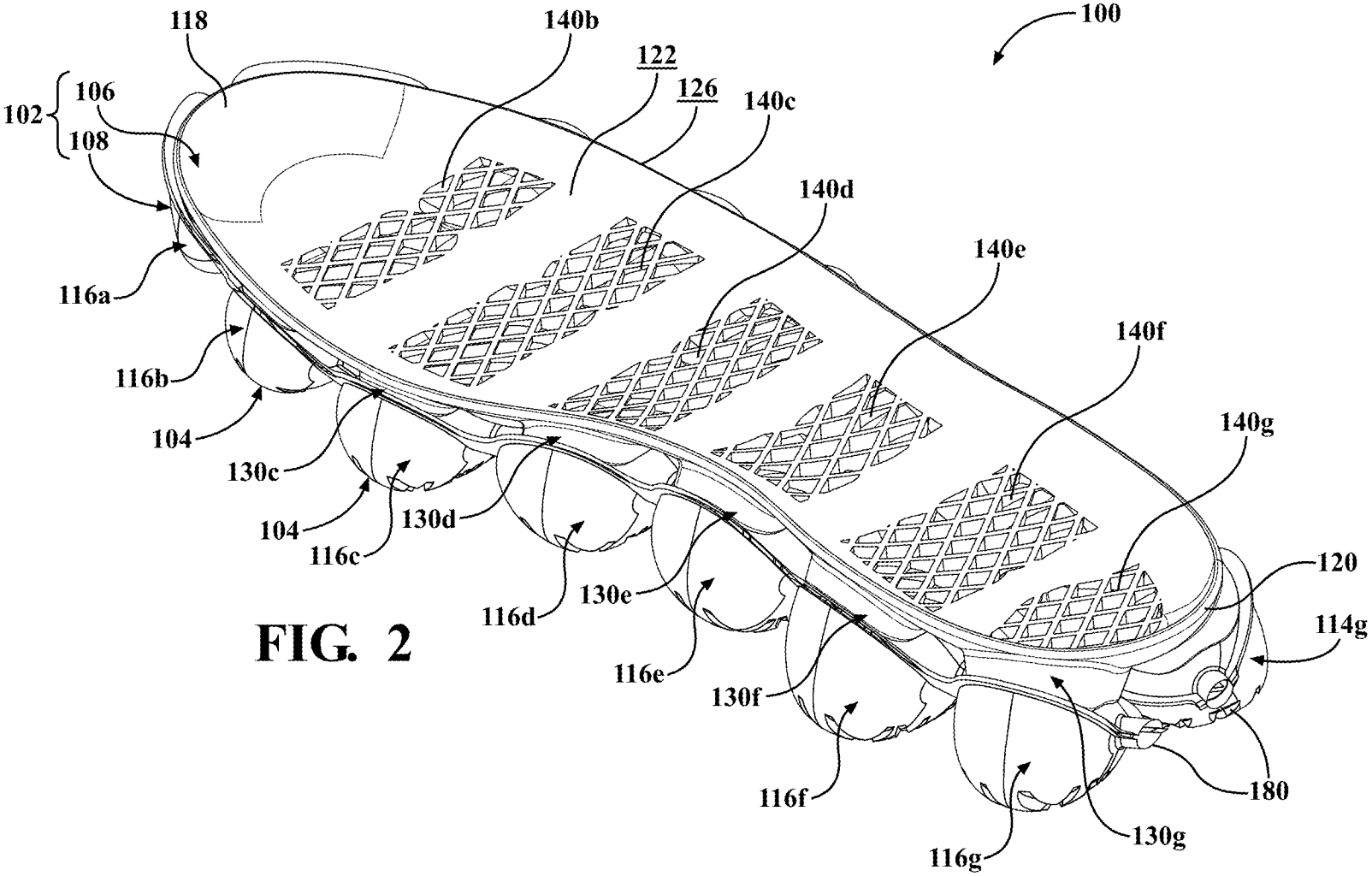
FIG. 2 is a top perspective view of the sole structure of FIG. 1.

With reference to FIGS. 1 and 2, the sole structure 100 includes a midsole 102 configured to provide cushioning characteristics to the sole structure 100, and an outsole 104 configured to provide a ground-engaging surface of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 includes a chassis 106 extending from the anterior end 12 to the posterior end 14 and a cushioning arrangement 108 attached to the chassis 106. The chassis 106 is configured to be attached to the upper 200 and provides an interface between the upper 200 and the cushioning arrangement 108. In the illustrated example, the cushioning arrangement 108 includes a first bladder 110 extending along the lateral side 16 and a second bladder 112 extending along the medial side 18. As described in greater detail below, the first bladder 110 includes a plurality of first chambers 114*a*-114*g* and the second bladder 112 includes a plurality of second chambers 116*a*-116*g*.

With reference to FIGS. 1-4A, the chassis 106 of the midsole 102 extends continuously from a first end 118 at the anterior end 12 to a second end 120 at the posterior end 14. The chassis 106 includes a top side 122 defining a footbed of the sole structure 100 and a bottom side 124 formed on an opposite side from the top side 122. A peripheral side surface 126 of the chassis 106 extends between the top side 122 and the bottom side 124 and defines an outer peripheral profile of the chassis 106 and the footbed.

Figure 4:
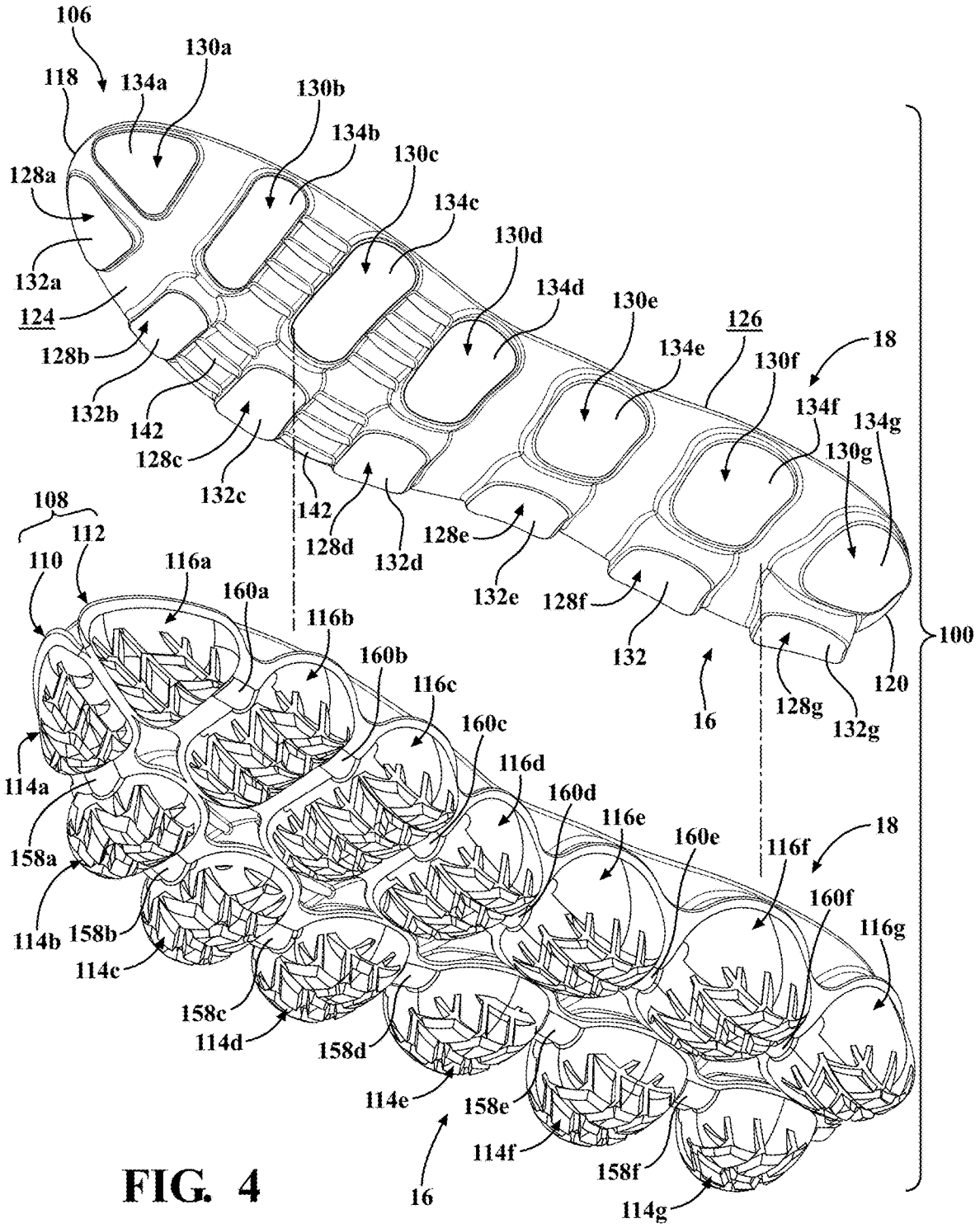
FIG. 4 is an exploded bottom perspective view of the sole structure of FIG. 1.
Figure 4A:
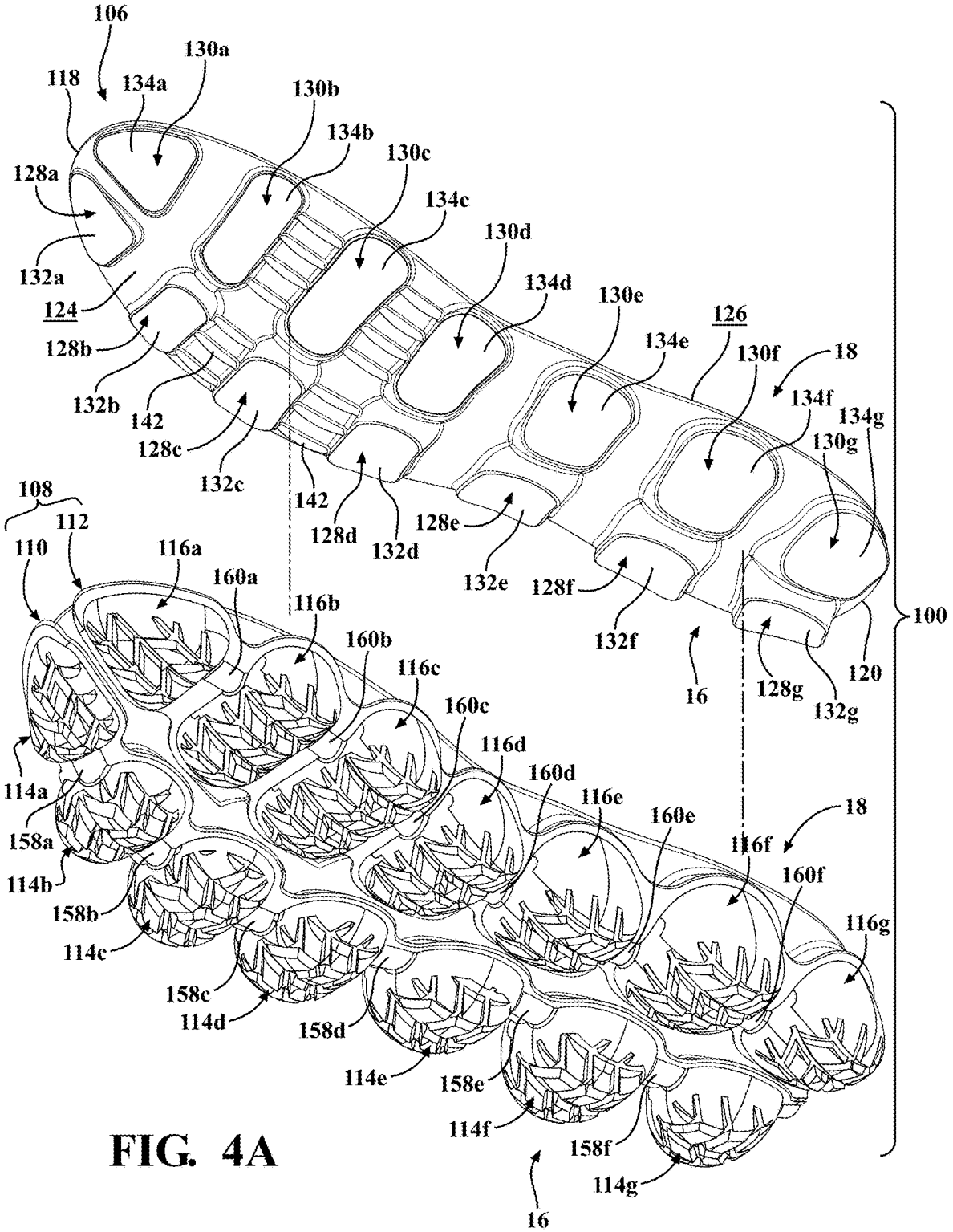
FIG. 4A is an exploded bottom perspective view of the sole structure of FIG. 1 showing the first bladder and the second bladder formed as separate pieces.

As best shown in FIGS. 4 and 4A, the bottom side 124 of the chassis 106 includes a plurality of sockets 128*a*-128*g*, 130*a*-130*g* arranged along the length of the chassis 106 from the first end 118 to the second end 120. As discussed in greater detail below, the sockets 128*a*-128*g*, 130*a*-130*g* are configured to receive corresponding ones of the chambers 114*a*-114*g*, 116*a*-116*g* of the cushioning arrangement 108. In the illustrated example, the chassis 106 includes a plurality of first sockets 128*a*-128*g* arranged in series along the lateral side 16 of the chassis 106 from the first end 118 to the second end 120. The chassis 106 further includes a plurality of second sockets 130*a*-130*g* arranged in series along the medial side 18 of the chassis 106 from the first end 118 to the second end 120. Each one of the first sockets 128*a*-128*g* on the lateral side 16 is aligned along the lateral direction of the sole structure 100 with a respective one of the second sockets 130*a*-130*g* on the medial side 18. In other words, the first sockets 128*a*-128*g* and the second sockets 130*a*-130*g* cooperate with each other to define rows of the sockets 128*a*-128*g*, 130*a*-130*g* along the length of the sole structure 100.

Each of the first sockets 128*a*-128*g* and the second sockets 130*a*-130*g* includes a receptacle 132*a*-132*g*, 134*a*-134*g* formed at a distal end of the socket 128*a*-128*g*, 130*a*-130*g*. The receptacles 132*a*-132*g*, 134*a*-134*g* are configured to interface with respective ones of the chambers 114*a*-114*g*, 116*a*-116*g* to secure a position and orientation of the chamber 114*a*-114*g*, 116*a*-116*g* relative to the chassis 106. In the illustrated example, the receptacles 132*a*-132*g*, 134*a*-134*g* are each defined by a concave surface configured to mate with a corresponding convex surface of one of the chambers 114*a*-114*g*, 116*a*-116*g*.

Figure 6A:
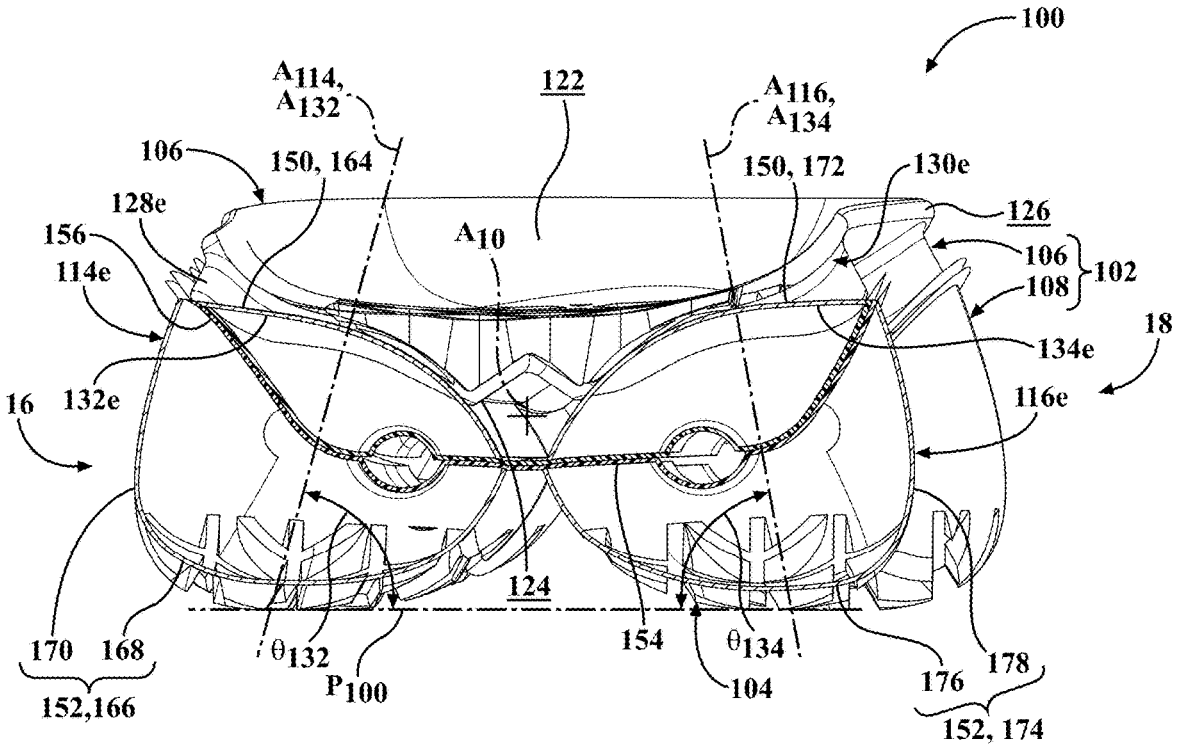
FIG. 6A is a cross-sectional view of the sole structure of FIG. 1, taken along Line 6A-6A in FIG. 5.
Figure 7A:
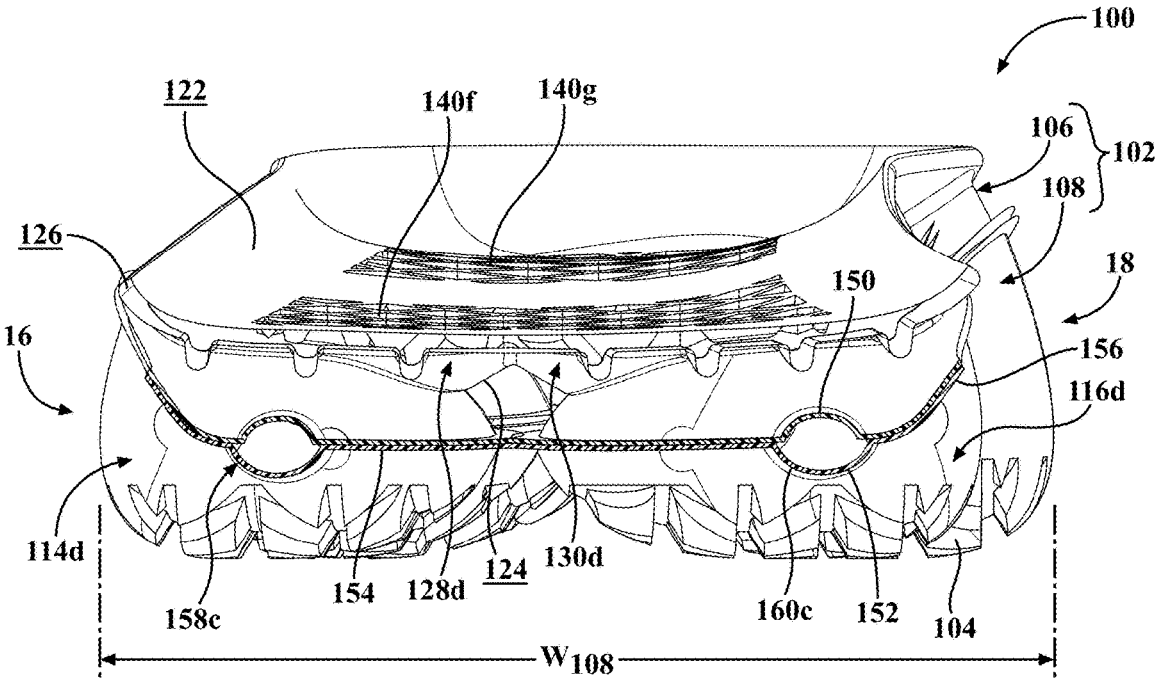
FIG. 7A is a cross-sectional view of the sole structure of FIG. 1, taken along Line 7-7 in FIG. 5.
Figure 6B:
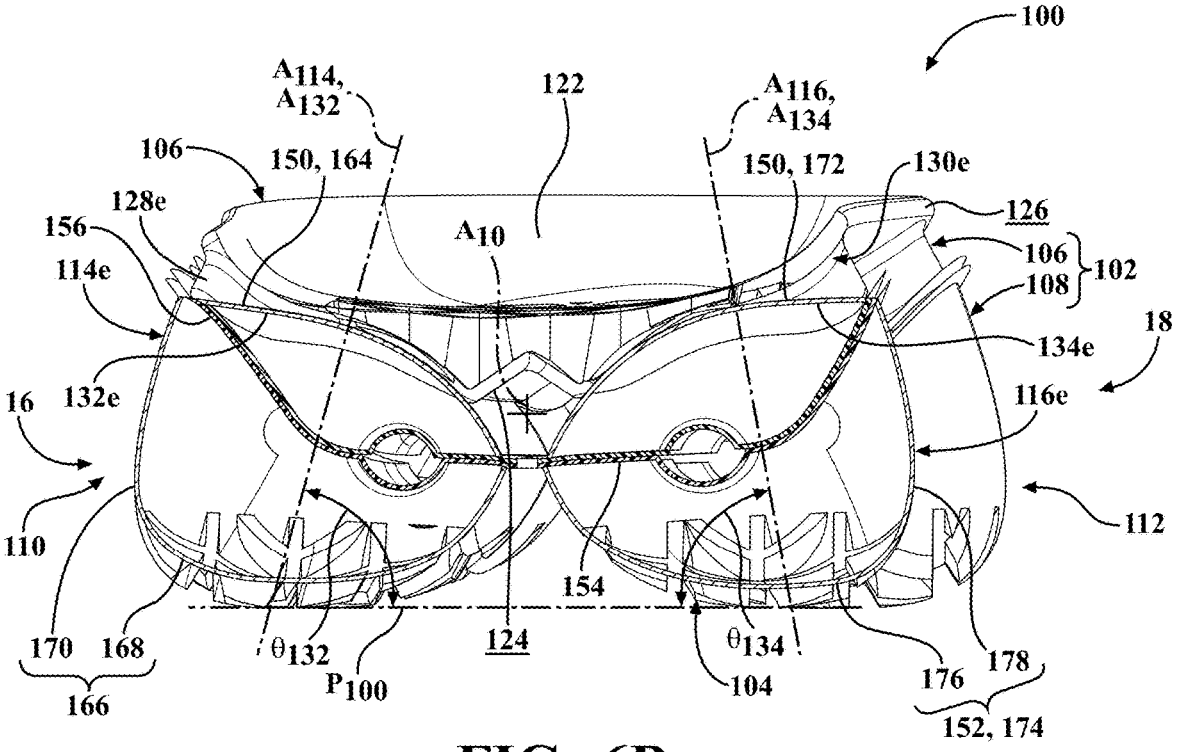
FIG. 6B is a cross-sectional view of a second aspect of the sole structure of FIG. 1, taken along Line 6B-6B in FIG. 5A.
Figure 7B:
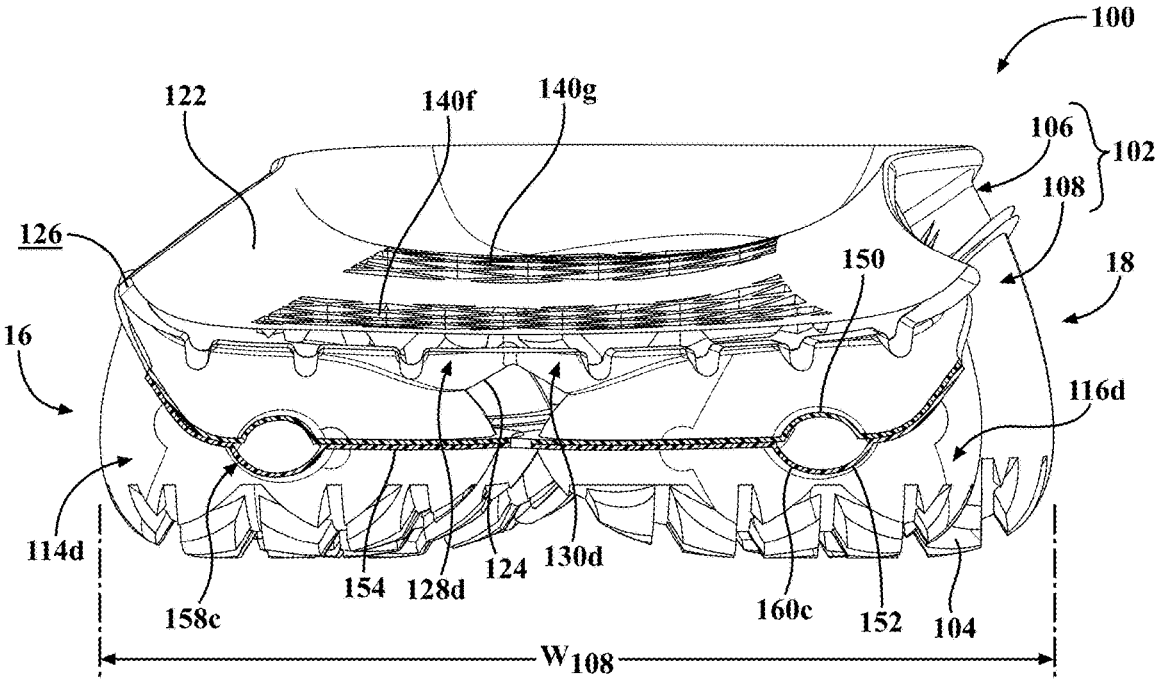
FIG. 7B is a cross-sectional view of a second aspect of the sole structure of FIG. 1, taken along Line 7B-7B in FIG. 5A.

With reference to FIGS. 6A and 6B, a cross-sectional view of the sole structure 100 shows a row including a first socket 128*e* of the chassis 106 and associated with the first bladder 110 and a respective second socket 130*e* of the chassis 106 and associated with the second bladder 112. While the sizes and shapes of the sockets 128*a*-128*g*, 130*a*-130*g* of the chassis 106 may differ, it will be appreciated that the features described herein with respect to the sockets 128*e*, 130*e* are common among all of the sockets 128*a*-128*g*, 130*a*-130*g* such that the remaining sockets are not individually shown and described. As shown in FIGS. 6A and 6B, the first receptacle 132*e* of the first socket 128*e* and the second receptacle 134*e* of the second socket 130*e* are oriented in opposite directions away from the longitudinal axis $A_{10}$. In other words, the first receptacle 132*e* disposed along the lateral side 16 of the chassis 106 is oriented towards the lateral side 16 at a first oblique angle $\theta_{132}$ relative to the ground-contacting plane $P_{100}$ and the second receptacle 134*e* disposed along the medial side 18 of the chassis 106 is oriented towards the medial side 18 at a second oblique angle $\theta_{134}$ relative to the ground-contacting plane $P_{100}$. Here, the first oblique angle $\theta_{132}$ and the second oblique angle $\theta_{134}$ are transverse to each other, such that axes $A_{132}$, $A_{134}$ extending normal to the surfaces defining the receptacles 132*e*, 134*e* converge with each other in a direction extending away from the ground-contacting plane $P_{100}$.

The first oblique angle $\theta_{132}$ and the second oblique angle $\theta_{134}$ may be the same (i.e., equal angles in opposite directions) for each receptacle 132*e*, 134*e* in a row. Additionally or alternatively, the receptacles 132*a*-132*g*, 134*a*-134*g* of other rows may have different values from each other. For example, and as discussed in greater detail below, receptacles 132*a*-132*g*, 134*a*-134*g* associated with portions of the sole structure 100 that are subjected to relatively high lateral forces (e.g., cutting movements) may have a greater outward orientation (i.e., smaller angles $\theta_{132}$, $\theta_{134}$). Conversely, receptacles 132*a*-132*g*, 134*a*-134*g* associated with portions of the sole structure 100 that are subjected to relatively high vertical forces (e.g., jumping movements) may have a greater vertical orientation (i.e., larger angles $\theta_{132}$, $\theta_{134}$).

Figure 3:
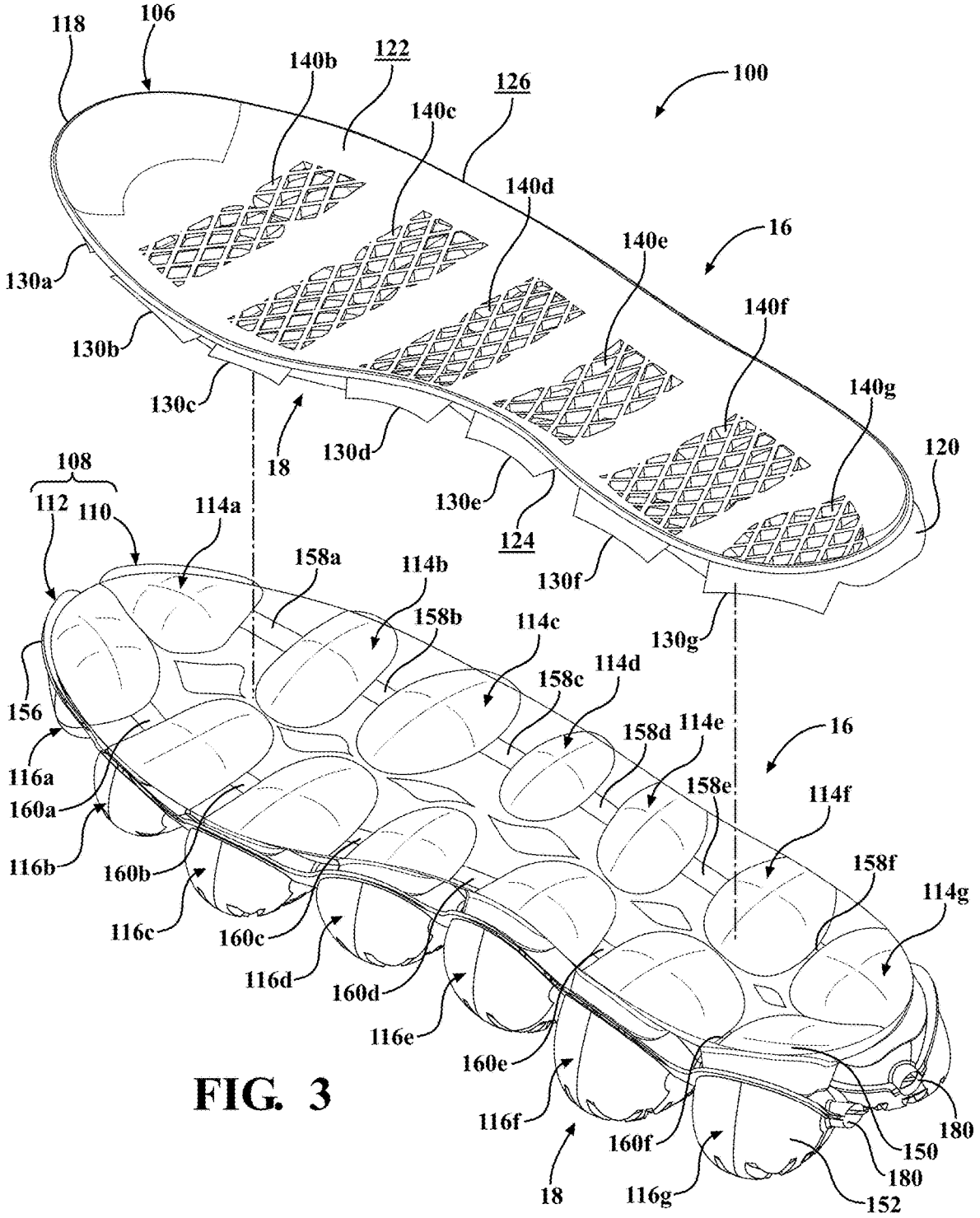
FIG. 3 is an exploded top perspective view of the sole structure of FIG. 1.
Figure 3A:
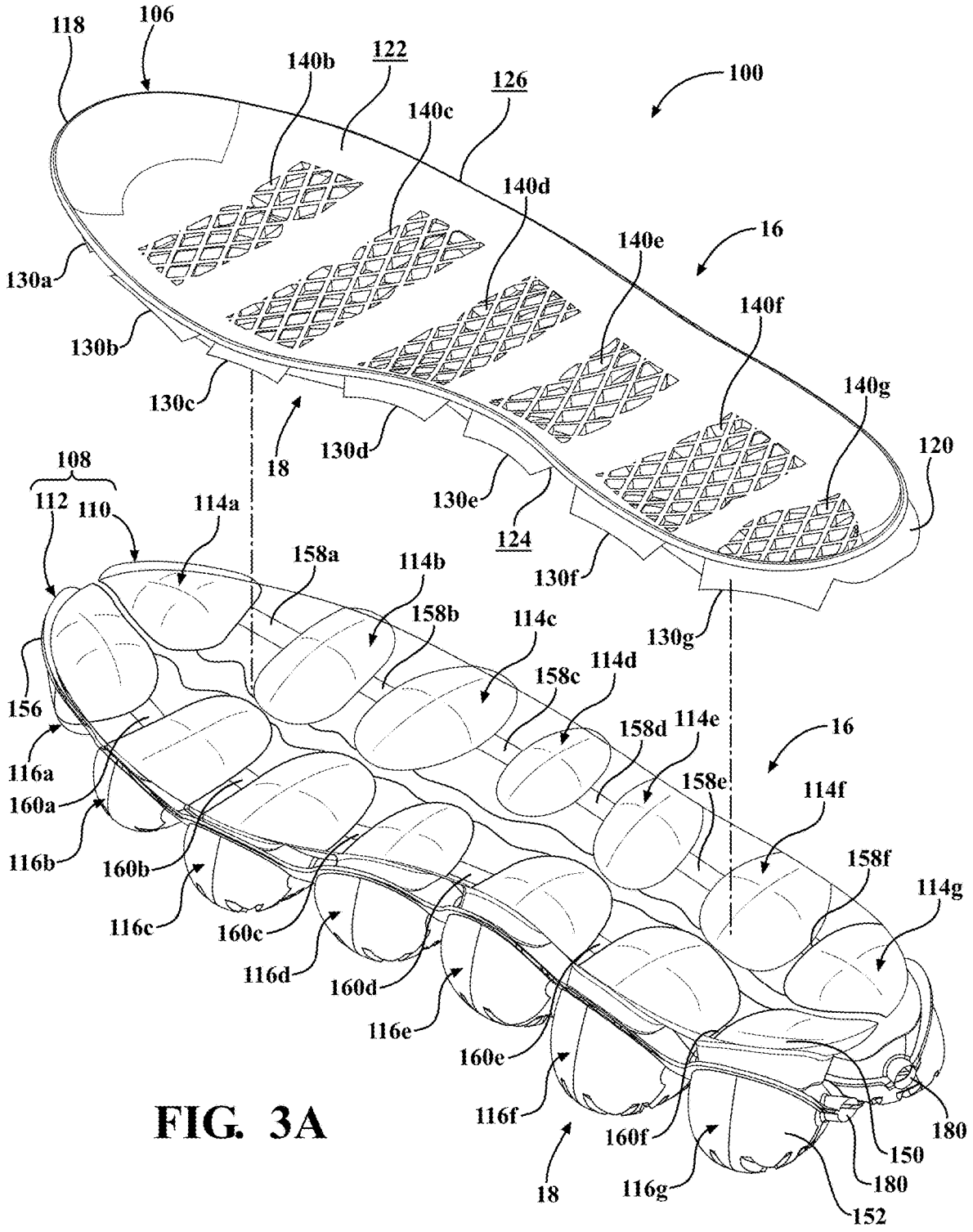
FIG. 3A is an exploded top perspective view of the sole structure of FIG. 1 showing the first bladder and the second bladder formed as separate pieces.

With continued reference to FIGS. 3 and 3A, the top side 122 of the chassis 106 includes one or more vents 140*b*-140*g* arranged between the first end 118 and the second end 120. In the illustrated example, the chassis 106 includes a plurality of the vents 140*b*-140*g* arranged in series from the first end 118 to the second end 120. Here, each one of the vents 140*b*-140*g* is aligned with a row of the sockets 128*b*-128*g*, 130*b*-130*g*. Each of the vents 140*b*-140*g* extends across the footbed from the lateral side 16 to the medial side 18 and includes a lattice structure defining a plurality of recesses in the top side 122. Here, the vents 140*b*-140*g* extend partially through the thickness of the chassis 106 from the top side 122. Thus, the vents 140*b*-140*g* are enclosed along the bottom side 124 of the chassis 106 to define a plurality of fluid cavities in the footbed to improve breathability within the article of footwear 10.

As shown in FIGS. 4 and 4A, the chassis 106 further includes a plurality of ribs 142 extending along the bottom side 124 in the forefoot region 20. As shown, the ribs 142 are arranged in parallel and each extend along the longitudinal direction between subsequent ones of the sockets 128*b*-128*d*, 130*b*-130*d*. The ribs 142 are configured to provide longitudinal stiffness along the ball portion $20_B$ of forefoot region 20. In contrast, the bottom side 124 of the chassis 106 includes a continuous surface between the sockets 128*a*-128*g*, 130*a*-130*g* in the toe portion $20_T$, the mid-foot region 22, and heel region 24 to allow a greater degree of articulation between the sockets 128*a*-128*g*, 130*a*-130*g*.

As described above, the chassis 106 is formed of a resilient polymeric material, such as foam or rubber, to impart properties of cushioning, responsiveness, and energy distribution to the foot of the wearer. Example resilient polymeric materials for the chassis 106 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Examples of suitable polyurethanes include those discussed below for the barrier layers of the bladders. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

With continued reference to FIGS. 1 and 2, the cushioning arrangement 108 of the midsole 102 includes the first bladder 110 and the second bladder 112 arranged in a side-by-side relationship along the length of the sole structure 100. Each of the bladders 110, 112 includes an interior void filled with a compressible material. As shown in the cross-sectional views of FIGS. 6A-8, each of the bladders 110, 112 may be formed by an opposing pair of barrier layers 150, 152, which can be joined to each other to form a web area 154 and a peripheral seam 156 surrounding each of the bladders 110, 112. As discussed below, the barrier layers 150, 152 include an upper barrier layer 150 and a lower barrier layer 152.

As used herein, the term "barrier layer" (e.g., barrier layers 150, 152) encompasses both monolayer and multilayer films. In some embodiments, one or both of the barrier layers 150, 152 are each produced (e.g., thermoformed or blow molded) from a monolayer film (a single layer). In other embodiments, one or both of the barrier layers 150, 152 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 150, 152 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 150, 152 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 150, 152 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In embodiments where the barrier layers 150, 152 include two or more sublayers, examples of suitable multilayer films include microlayer films, such as those disclosed in Bonk et al., U.S. Pat. No. 6,582,786, which is incorporated by reference in its entirety. In further embodiments, the barrier layers 150, 152 may each independently include alternating sublayers of one or more TPU copolymer materials and one or more EVOH copolymer materials, where the total number of sublayers in each of the barrier layers 150, 152 includes at least four (4) sublayers, at least ten (10) sublayers, at least twenty (20) sublayers, at least forty (40) sublayers, and/or at least sixty (60) sublayers.

The bladders 110, 112 can be produced from the barrier layers 150, 152 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 150, 152 can be produced by co-extrusion followed by vacuum thermoforming to form the profile of the cushioning arrangement 108, which can optionally include one or more valves (e.g., one way valves) that allows the cushioning arrangement 108 to be filled with the fluid (e.g., gas).

The barrier layers 150, 152 have a low gas transmission rate to preserve its retained gas pressure. In some embodiments, the barrier layers 150, 152 have a gas transmission rate for nitrogen gas that is at least about ten (10) times lower than a nitrogen gas transmission rate for a butyl rubber layer of substantially the same dimensions. In an aspect, cushioning arrangement 108 has a nitrogen gas transmission rate of 15 cubic-centimeter/square-meter·atmosphere·day ($cm^3/m^2$·atm·day) or less for an average film thickness of 500 micrometers (based on thicknesses of barrier layers 150, 152). In further aspects, the transmission rate is 10 $cm^3/m^2$·atm·day or less, 5 $cm^3/m^2$·atm·day or less, or 1 $cm^3/m^2$·atm·day or less.

As previously mentioned, the bladders 110, 112 may be generally described as including the upper barrier layer 150 configured to attach to the sockets **128*a*-128*g*, 130*a*-130*g*, and the lower barrier layer 152 configured to project from the sockets 128*a*-128*g*, 130*a*-130*g*. The barrier layers 150, 152 are joined together along the peripheral seam 156 to define an outer peripheral profile of the bladders 110, 112**.

Interior surfaces of the barrier layers 150, 152 are spaced apart from each other to define an interior void filled with a compressible material. The interior voids of the bladders 110, 112 can be provided in a fluid-filled (e.g., as provided in footwear 10) or in an unfilled state. The bladders 110, 112 can be filled to include any suitable fluid, such as a gas or liquid. In an aspect, the gas can include air, nitrogen ($N_2$), or any other suitable gas. The fluid provided to the bladders 110, 112 can result in the bladders 110, 112 being pressurized at a pressure. In some examples, the pressure ranges from 0 psi to 25 psi, and more particularly from 5 psi to 12 psi, and even more particularly from 7 psi to 10 psi. Optionally, the bladders 110, 112 may be pressurized at different pressures. Alternatively, the fluid provided to the bladders 110, 112 can be at atmospheric pressure such that the bladders 110, 112 are not pressurized but, rather, simply contain a volume of fluid at atmospheric pressure. In other aspects, the bladders 110, 112 can alternatively include other compressible media, such as pellets, beads, ground recycled material, and the like (e.g., foamed beads and/or rubber beads).

With reference to FIGS. 1-8, each bladder 110, 112 includes a plurality of cushioning pods or chambers **114*a*-114*g*, 116*a*-116*g* connected by the web area 154. The first bladder 110 extends along the lateral side 16 of the sole structure 100 and includes a plurality of first chambers 114*a*-114*g* arranged in series between the anterior end 12 and the posterior end 14. The first chambers 114*a*-114*g* are joined together by segments of the web area 154 to form a chain-like first bladder 110 extending along the lateral side 16. Adjacent ones of the first chambers 114*a*-114*g* are fluidly connected by respective conduits 158*a*-158*f* formed in the web area 154. As shown in FIG. 4, each conduit 158*a*-158*f* extends from a posterior end of a first one of the first chambers 114*a*-114*f* to an anterior end of a second one of the first chambers 114*b*-114*g*, such that all of the first chambers 114*a*-114*g*** are fluidly coupled in series.

The second bladder 112 extends along the medial side 18 of the sole structure 100 and includes a plurality of second chambers **116*a*-116*g* arranged in series between the anterior end 12 and the posterior end 14. The second chambers 116*a*-116*g* are joined together by segments of the web area 154 to form a chain-like bladder 112 extending along the medial side 18. Adjacent ones of the second chambers 116*a*-116*g* are fluidly connected by respective conduits 160*a*-160*f* formed in the web area 154. As shown in FIGS. 4 and 4A, each conduit 160*a*-160*f* extends from a posterior end of a first one of the second chambers 116***a*-116*f* to an anterior end of a second one of the second chambers 116*b*-116*g*, such that all of the second chambers 116*a*-116*g* are fluidly coupled in series.

Figure 8:
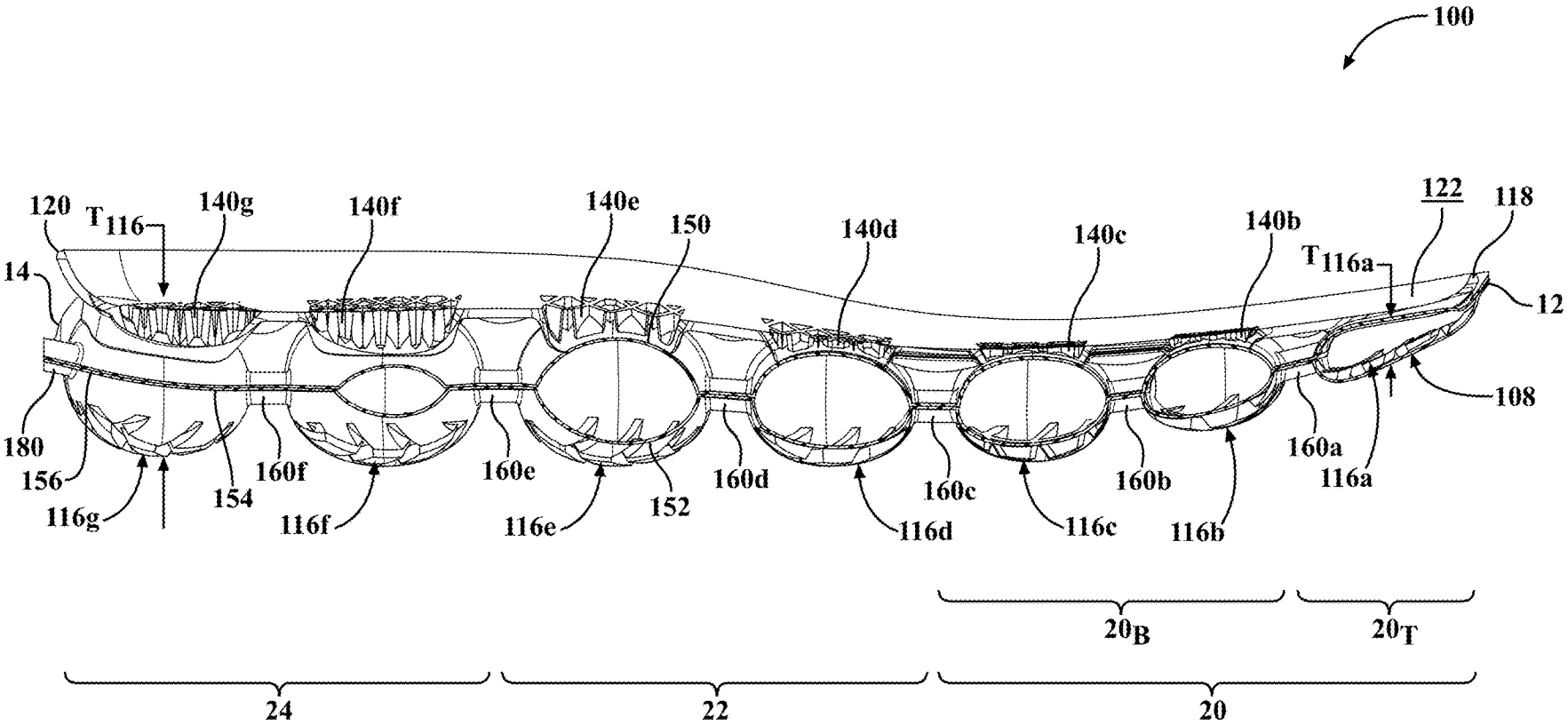
FIG. 8 is a cross-sectional view of the sole structure of FIG. 1, taken along Line 8-8 in FIG. 5.

With reference to FIG. 8, a cross sectional view of the cushioning arrangement 108 shows a profile of the second bladder 112 and the second chambers 116*a*-116*g*. Here, a first toe chamber 116*a* is disposed in the toe portion $\mathbf{20}_T$ at the anterior end 12. A thickness $T_{116a}$ of the toe chamber 116*a* tapers constantly and continuously along the direction towards the anterior end 12 to provide the toe chamber 116*a* with a substantially triangular cross-sectional shape. The second bladder 112 further includes a pair of forefoot chambers 116*b*, 116*c* disposed in the ball portion $\mathbf{20}_B$ of the sole structure 100, a pair of mid-foot chambers 116*d*, 116*e* disposed in the mid-foot region 22, and a pair of heel chambers 116*f*, 116*g* disposed in the heel region 24. The forefoot chambers 116*b*, 116*d*, the mid-foot chambers 116*d*, 116*e*, and the heel chambers 116*f*, 116*g* have an ellipsoidal cross section along the longitudinal axis. Generally, the thicknesses $T_{116}$ (i.e., distance between upper barrier layer 150 and lower barrier layer 152) of the chambers 116*a*-116*g* increases along the direction from the anterior end 12 to the posterior end 14 such that the heel chambers 116*f*, 116*g* have a greater thickness than the mid-foot chambers 116*d*, 116*e* and the mid-foot chambers 116*d*, 116*e* have a greater thickness than the forefoot chambers 116*a*-116*c*. The first chambers 114*a*-114*g* of the first bladder 110 include a toe chamber 114*a*, a pair of forefoot chambers 114*b*, 114*c*, a pair of mid-foot chambers 114*d*, 114*e*, and a pair of heel chambers 114*f*, 114*g* having a substantially similar configuration to the corresponding chambers 116*a*-116*g* of the second bladder 112 shown in FIG. 8.

With reference to FIGS. 6A and 6B, a cross-sectional view taken through a row of the mid-foot chambers 114*e*, 116*e* is provided. The features shown and described with respect to the mid-foot chambers 114*e*, 116*e* are common among all chambers 114*a*-114*g*, 116*a*-116*g* except as otherwise stated herein. Each of the first chambers 114*a*-114*g* includes a first upper chamber wall 164 defined by the upper barrier layer 150 and a first lower chamber wall 166 defined by the lower barrier layer 152. The first upper chamber wall 164 defines a convex outer surface configured to interface with the corresponding concave surface of a respective one of the first receptacles 132*a*-132*g*. The first lower chamber wall 166 is generally hemispherical in shape and includes a bottom wall portion 168 defining the ground-contacting plane $P_{100}$ and a peripheral wall portion 170 extending from the bottom wall portion 168 to the first upper chamber wall 164.

Each of the second chambers 116*a*-116*g* includes a second upper chamber wall 172 defined by the upper barrier layer 150 and a second lower chamber wall 174 defined by the lower barrier layer 152. The second upper chamber wall 172 defines a convex outer surface configured to interface with the corresponding concave surface of a respective one of the second receptacles 134*a*-134*g*. The second lower chamber wall 174 is generally hemispherical in shape and includes a bottom wall portion 176 defining the ground-contacting plane and a peripheral wall portion 178 extending from the bottom wall portion 176 to the second upper chamber wall 172.

While the upper chamber walls 164, 172 and the lower chamber walls 166, 174 are generally hemispherical in shape, the upper chamber walls 164, 172 may have a greater radius of curvature (i.e., a flatter profile) than the lower chamber walls 166, 174 to provide the chambers 114*a*-114*g*, 116*a*-116*g* with a truncated-ellipsoidal shape. Each of the first chambers 114*a*-114*g*, 116*a*-116*g* defines a polar axis $A_{114}$, $A_{116}$ extending from a center point (i.e., an upper pole) of the upper chamber wall 164, 172 to a center point (i.e., a lower pole) of the lower chamber wall 166, 174. In other words, the polar axes $A_{114}$, $A_{116}$ extend between the center points or poles of the chamber walls 164, 166, 172, 174 and are generally aligned with the peripheral wall portions 170, 178 of the chambers 114*a*-114*g*, 116*a*-116*g*.

As discussed previously, the chambers 114*a*-114*g*, 116*a*-116*g* are received by respective ones of the sockets 128*a*-128*g*, 130*a*-130*g*. Specifically, the upper chamber walls 164, 172 of the chambers 114*a*-114*g*, 116*a*-116*g* interface with the receptacles 132*a*-132*g*, 134*a*-134*g* of the sockets 128*a*-128*g*, 130*a*-130*g* to position and orient the chambers 114*a*-114*g*, 116*a*-116*g*. Here, the polar axes $A_{114}$, $A_{116}$ of the chambers 114*a*-114*g*, 116*a*-116*g* are coaxially aligned with the respective axes $A_{132}$, $A_{134}$ such that the polar axes $A_{114}$, $A_{116}$ of the chambers 114*a*-114*g*, 116*a*-116*g* are oriented at the oblique angles $\theta_{132}$, $\theta_{134}$ relative to the ground-contacting plane $P_{100}$ when the sole structure 100 is assembled. As shown, the first chambers 114*a*-114*g* are oriented at the first oblique angle $\theta_{132}$ towards the lateral side 16 and ground-contacting plane and the second chambers 114*a*-114*g* are oriented at the second oblique angle $\theta_{134}$ towards the medial side 18 and ground-contacting plane $P_{100}$.

The angular orientations of the chambers 114*a*-114*g*, 116*a*-116*g* results in the peripheral wall portions 170, 178 being similarly oriented and projecting outwardly from the peripheral side surface 126 of the chassis 106. As shown, the peripheral wall portions 170, 178 extend outwardly from the peripheral side surface 126 on each of the lateral side 16 and the medial side 18 such that the chambers 114*a*-114*g*, 116*a*-116*g* provide the cushioning arrangement 108 with a greater width $W_{108}$ (FIGS. 7A and 7B) than the width of the footbed. Furthermore, the angular orientation of the peripheral wall portions 170, 178 provides improved lateral stability, as lateral forces applied to the sole structure 100 are transmitted as axial forces along the length of the peripheral wall portions 170, 178 rather than pure bending forces transverse to the peripheral wall portions 170, 178.

As shown in FIGS. 3A, 4A, 5A, 6B and 7B, the first bladder 110 and the second bladder 112 are formed as independent components that are separate from one another and are separately attached to the chassis 106. FIGS. 3A and 4A show the first bladder 110 spaced apart from each other. However, when assembled to the chassis 106, the inner periphery of the first bladder 110 and the second bladder 112 may touch each other. Thus, the portion of the web area 154 connecting the first chambers 114*a*-114*g* is disconnected from the portion of the web area 154 connecting the second chambers 116*a*-116*g*. Furthermore, as discussed below, the first bladder 110 and the second bladder 112 are independently pressurized via inflation ports 180 formed in each of the heel chambers 114*g*, 116*g* (FIG. 3B). Thus, fluid pressure within the first bladder 110 may be different than the fluid pressure within the second bladder 112 during use. For example, when the first bladder 110 is compressed during a lateral movement, the pressure within the first bladder 110 may increase to a greater extent than the pressure in the second bladder 112.

FIGS. 3, 4, 5, 6A and 7A depict a cushioning arrangement 108 where the first bladder 110 and the second bladder 112 are formed as a unitary piece. The web area 154 connecting the first chambers 114*a*-114*g* is connected to the portion of the web area 154 connecting the second chambers 116*a*-116*g*. As such, the cushioning arrangement 108 may be attached to the chassis 106 as a single piece, making assembly easier relative to a cushioning arrangement 108 wherein the first bladder 110 and the second bladder 112 are formed as independent components. It should be appreciated that the connection of the first bladder 110 and the second bladder 112 allows the cushioning arrangement 108 to function as a unitary piece relative to the cushioning arrangement 108 where the first bladder 110 and the second bladder 112 are formed as independent components.

The outsole 104 of the sole structure 100 extends continuously from the anterior end 12 to the posterior end 14 of the sole structure 100 and defines a ground-contacting surface of the footwear 10. In the illustrated example, the outsole 104 is co-molded as part of the lower barrier layer 152. In other examples, the outsole 104 may be formed separately from the cushioning arrangement 108 and attached to the lower barrier layer 152 after the cushioning arrangement is formed. Optionally, the outsole 104 may be formed as a fragmentary structure including independent fragments attached to each of the chambers 114*a*-114*g*, 116*a*-116*g*.

The upper 200 is attached to the sole structure 100 and includes interior surfaces that define an interior void configured to receive and secure a foot for support on sole structure 100. The upper 200 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort.

Figure 9B:
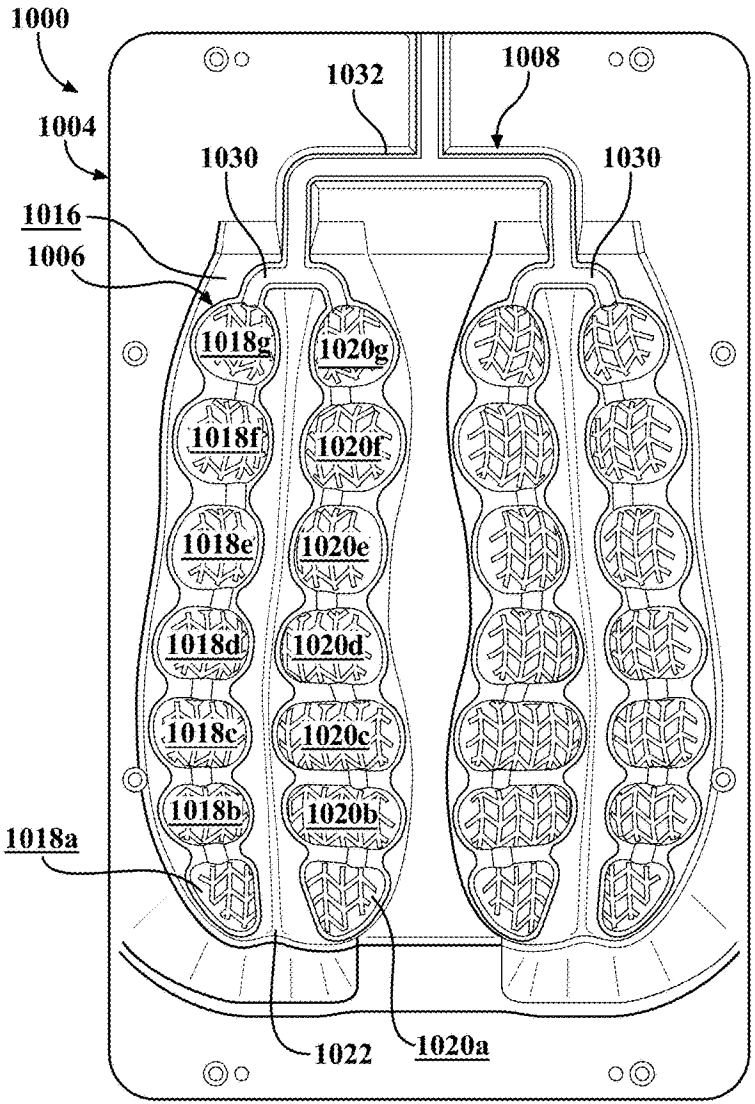
FIGS. 9A and 9B are plan views of mold plates of a molding system for forming a bladder of a sole structure according to the principles of the present disclosure.
Figure 9A:
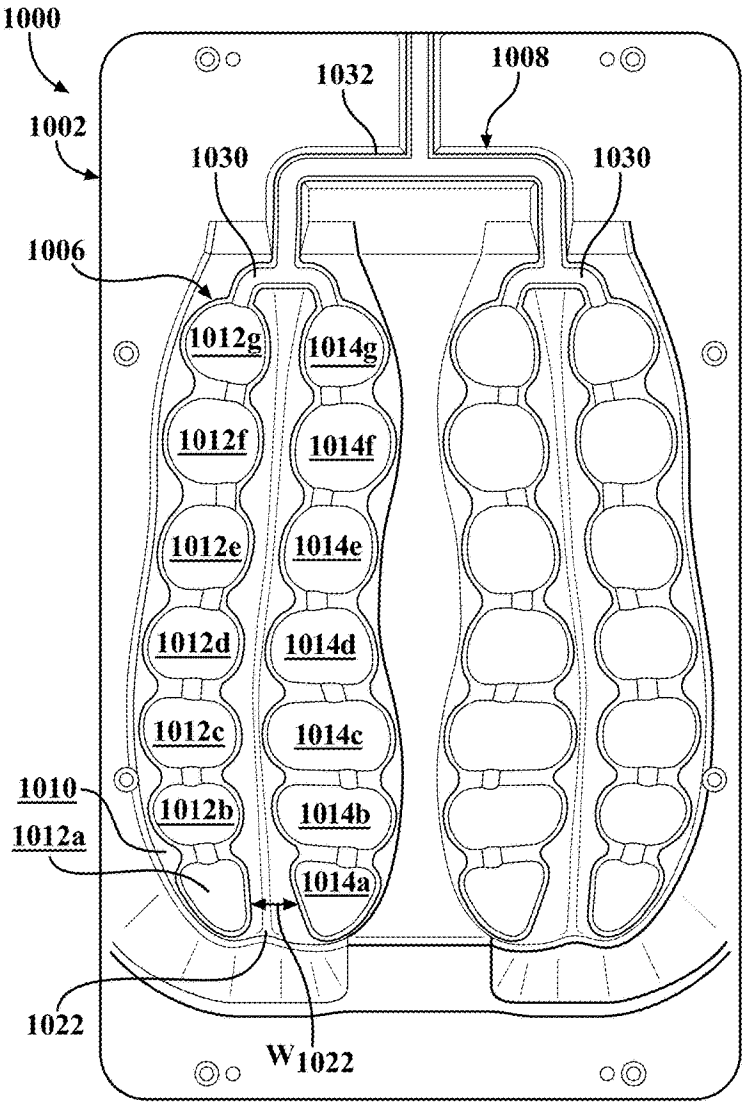

Referring now to FIGS. 9A and 9B, a mold system 1000 for forming the cushioning arrangement 108 is provided. FIG. 9A shows an upper mold half 1002 and FIG. 9B shows a lower mold half 1004. In use, the upper mold half 1002 and the lower mold half 1004 cooperate to define a mold cavity 1006 for forming the cushioning arrangement 108. In the illustrated example, the mold system 1000 defines a pair of mold cavities 1006 for forming cushioning arrangements 108 corresponding to left and right sole structures 100. Aside from being mirrored, the features of each of the mold cavities 1006 are the same, such that only a single mold cavity 1006 is described herein. The mold cavities 1006 are fluidly connected to each other by an inflation manifold 1008 such that the left and right cushioning arrangements 108 can be simultaneously pressurized at the same pressure.

With reference to FIG. 9A, the upper mold plate 1002 includes an upper mold surface 1010 defining a plurality of first upper chamber cavities 1012*a*-1012*g* and a plurality of second upper chamber cavities 1014*a*-1014*g*. The first upper chamber cavities 1012*a*-1012*g* and the second upper chamber cavities 1014*a*-1014*g* are configured to form a profile of the upper chamber walls 164, 172 of the chambers 114*a*-114*g*, 116*a*-116*g*. In FIG. 9B, the lower mold plate 1004 includes a lower mold surface 1016 defining a plurality of first lower chamber cavities 1018*a*-1018*g* and a plurality of second lower chamber cavities 1020*a*-1020*g*. The first lower chamber cavities 1018*a*-1018*g* and the second lower chamber cavities 1020*a*-1020*g* are configured to form a profile of the lower chamber walls 166, 174 of the chambers 114*a*-114*g*, 116*a*-116*g* and may also define a pattern of the outsole 104 to be co-molded with or imparted to the lower chamber walls 166, 174.

The upper mold surface 1010 and the lower mold surface 1016 cooperate to define a ridge 1022 extending between and separating the first chamber cavities 1012*a*-1012*g*, 1018*a*-1018*g* and the second chamber cavities 1014*a*-1014*g*, 1020*a*-1020*g*. As discussed in greater detail below, the ridge 1022 includes a pair of ridge surfaces 1024*a*, 1024*b* formed at an angle relative to each other. A width $W_{1022}$ of the ridge 1022 separates the first chamber cavities 1012*a*-1012*g*, 1018*a*-1018*g* and the second chamber cavities 1014*a*-1014*g*, 1020*a*-1020*g* along the length of the mold cavity 1006.

As shown, the width $W_{1022}$ of the ridge 1022 may be variable along the length of the mold cavity 1006. For example, in a portion of the mold cavity 1006 including chamber cavities 1012*a*, 1014*a*, 1018*a*, 1020*a* corresponding to the toe chambers 114*a*, 116*a*, the width of the ridge 1022 tapers along the direction from the anterior end to the posterior end. In other words, the cavities 1012*a*, 1014*a*, 1018*a*, 1020*a* may be splayed adjacent to the anterior end such that once the cushioning arrangement 108 is formed, the first toe chamber 114*a* and the second toe chamber 116*a* can be bent inwardly towards each other. As the toe chambers 114*a*, 116*a* are bent inwardly, the toe chambers 114*a*, 116*a* will consequently curve upwardly (i.e., away from the ground-contacting plane $P_{100}$) to impart a curvature along the forefoot region 20 of the cushioning arrangement 108. Thus, the taper or splay of the ridge 1022 may be selected to tune the degree of curvature of the cushioning arrangement 108. For example, a greater splay between the toe chambers 114*a*, 116*a* will result in a greater curvature when the cushioning arrangement 108 is assembled.

Referring now to FIGS. 10A-10D, a cross-sectional view of a generic example of a mold system 1000 according to the present disclosure is provided. Thus, the mold system 1002 includes the upper mold plate 1002, the lower mold plate 1004, and a portion of a mold cavity 1006 corresponding to a generic first chamber 114 and second chamber 116 of a cushioning arrangement 108. As shown, the mold cavity 1006 includes the upper and lower first chamber cavities 1012*a*-1012*g*, 1018*a*-1018*g* and the upper and lower second chamber cavities 1014*a*-1014*g*, 1020*a*-1020*g* configured for forming a row including a first chamber 114 on the lateral side 16 and a second chamber 116 on the medial side 18.

As discussed above, when the sole structure 100 is assembled, the cushioning arrangement 108 is configured so that the chambers 114, 116 are oriented outwardly at oblique angles $\theta_{132}$, $\theta_{134}$, whereby the peripheral wall portions 170, 178 of the chambers 114, 116 are each oriented at an oblique angle and project beyond the peripheral side surface 126 of the chassis 106. Thus, a lower end of the peripheral wall portions 170, 178 (i.e., adjacent to the outsole 104) is positioned outwardly from the upper end peripheral wall (i.e., adjacent to the upper chamber wall 164, 172) when the sole structure 100 is assembled such that the outer periphery of the chambers 114, 116 is distended. Typically, mold cavities are designed with geometry corresponding to a finished geometry of the molded product and include draft angles designed to allow the molded product to be easily extracted from the mold cavity. However, forming the cushioning arrangement 108 in the finished configuration (i.e., assembled with the chassis 106) with the distended peripheral wall portions 170, 178 would require that the corresponding chamber cavities 1012*a*-1012*g*, 1018*a*-1018*g* include an undercut cavity wall corresponding to the distended shape of the chambers 114, 116. An undercut wall is difficult to manufacture and presents challenges in a vacuum forming process, as the inflated chambers 114, 116 may be constricted within the undercut and, thus, difficult to extract from the mold.

Figure 10A:
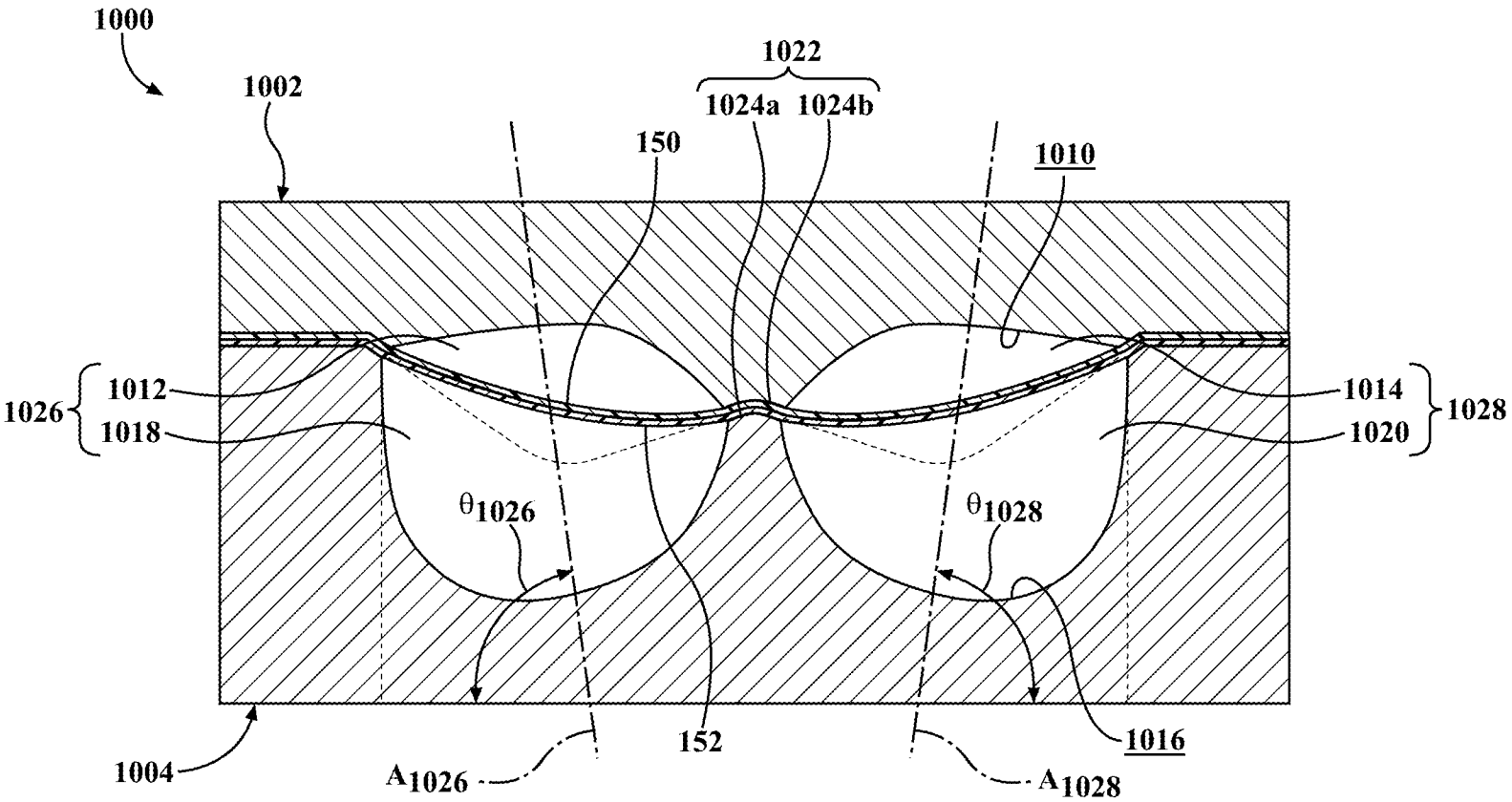
FIGS. 10A-10D are schematic views of a mold system including the mold plates of FIGS. 9A and 9B, showing a method of using the mold system to form a bladder according to the principles of the present disclosure.

With continued reference to FIG. 10A, the mold cavity 1006 of the upper mold half 1002 and the lower mold half

1004 are joined together to define chamber cavities 1026, 1028. The chamber cavities 1026, 1028 form the distended peripheral wall portions 170, 178 of the chambers 114, 116 without using an undercut lower mold surface 1016. Here, polar axes $A_{1026}$, $A_{1028}$ of the respective chamber cavities 1026, 1028 are oriented inwardly at oblique angles $\theta_{1026}$, $\theta_{1028}$ that are angularly offset from the finished orientations $\theta_{132}$, $\theta_{134}$ of the polar axes $A_{114}$, $A_{116}$ of the chambers 114, 116. Thus, the lower mold surface 1016 defining the lower chamber cavities 1018*a*-1018*g*, 1020*a*-1020*g* has a positive draft angle free of undercuts.

In a first step for forming the cushioning arrangement 108, the upper barrier layer 150 and the lower barrier layer 152 are positioned between the mold plates 1002, 1004 and the mold plates 1002, 1004 are moved to the closed configuration to seal the barrier layers 150, 152 at the respective web areas 154 and peripheral seams 156. The barrier layers 150, 152 may be joined together using any means for joining elastomeric materials, such as welding, thermal bonding or melding, and/or chemical adhesives, as discussed previously.

Figure 10B:
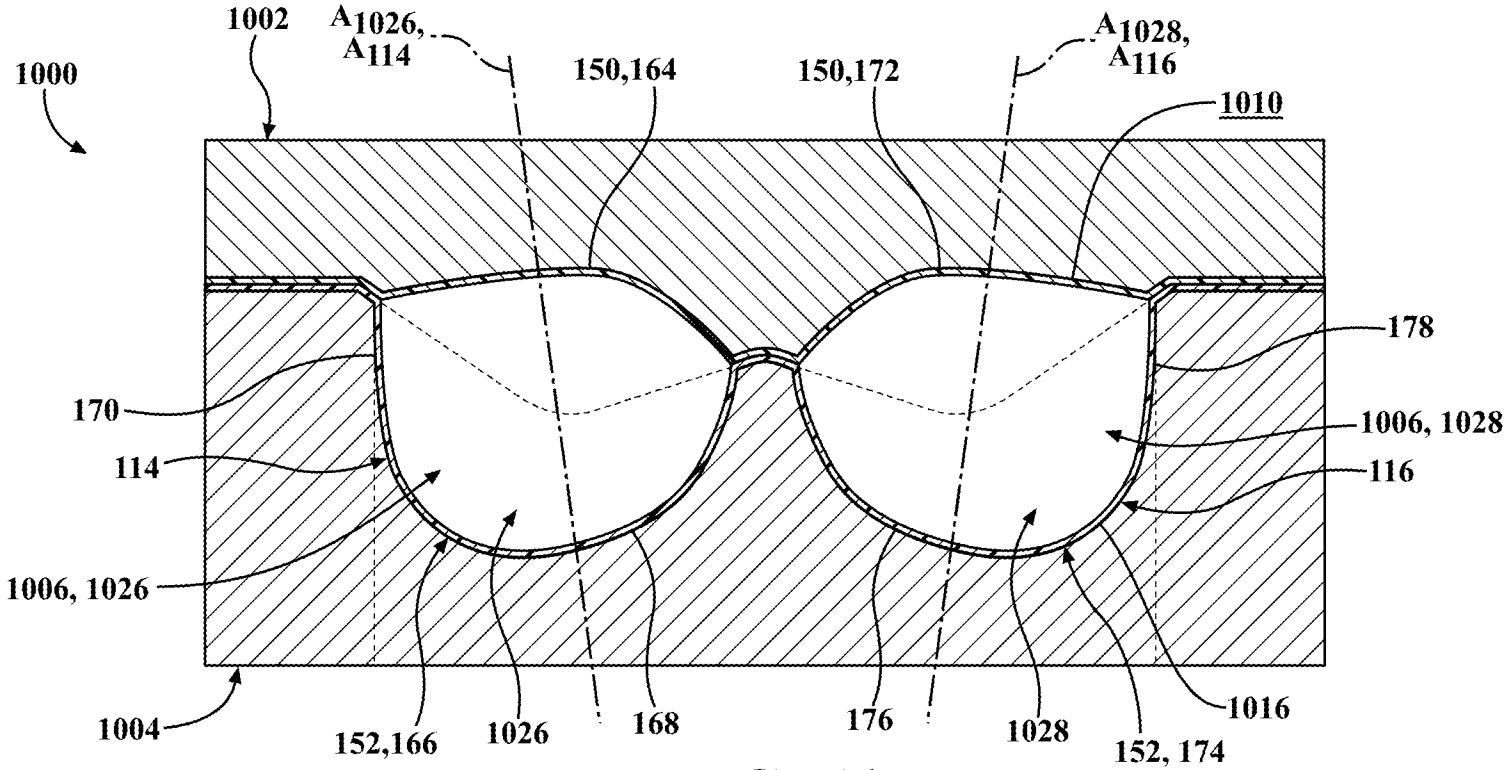
Figure 10C:
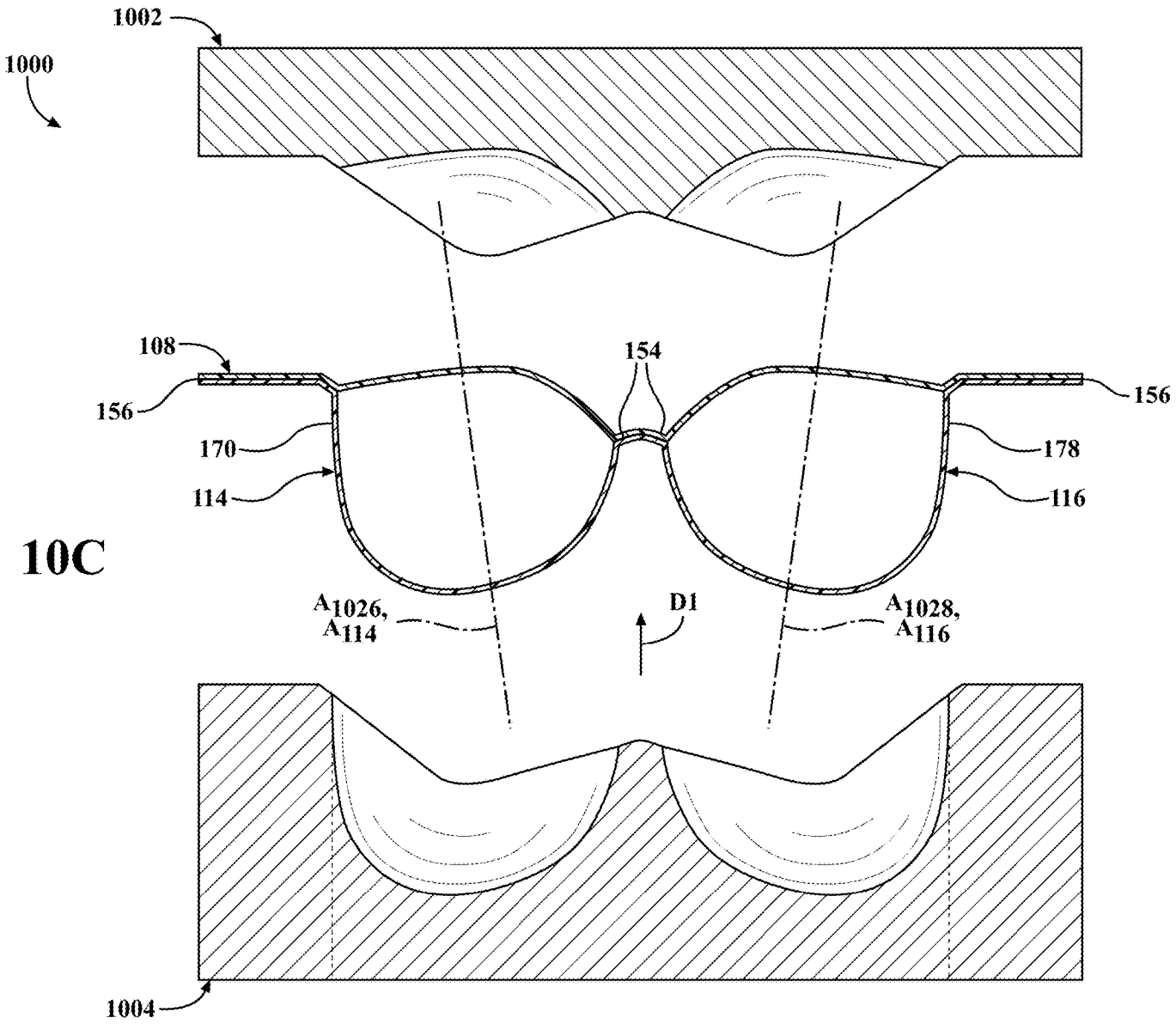

Referring to FIG. 10B, with the barrier layers 150, 152 joined together to form a seal, the bladders 110, 112 are biased against the mold surfaces 1010, 1016 to form the geometries of the bladders 110, 112. The barrier layers 150, 152 may be biased against the mold surfaces 1010, 1016 using negative pressure within the chamber cavities 1026, 1028 (i.e., vacuum molding) and/or by introducing positive pressure within the interior void of the bladders 110, 112 via the inflation manifold 1008. As shown in FIGS. 9A and 9B, the inflation manifold 1008 may include a plurality of inflation conduits 1030 branching from an inflation header 1032 such that the bladders 110, 112 can be simultaneously pressurized. Once the bladders 110, 112 are formed, the inflation ports 180 of each bladder 110, 112 may be sealed to fluidly isolate the first bladder 110 from the second bladder 112.

Figure 10D:
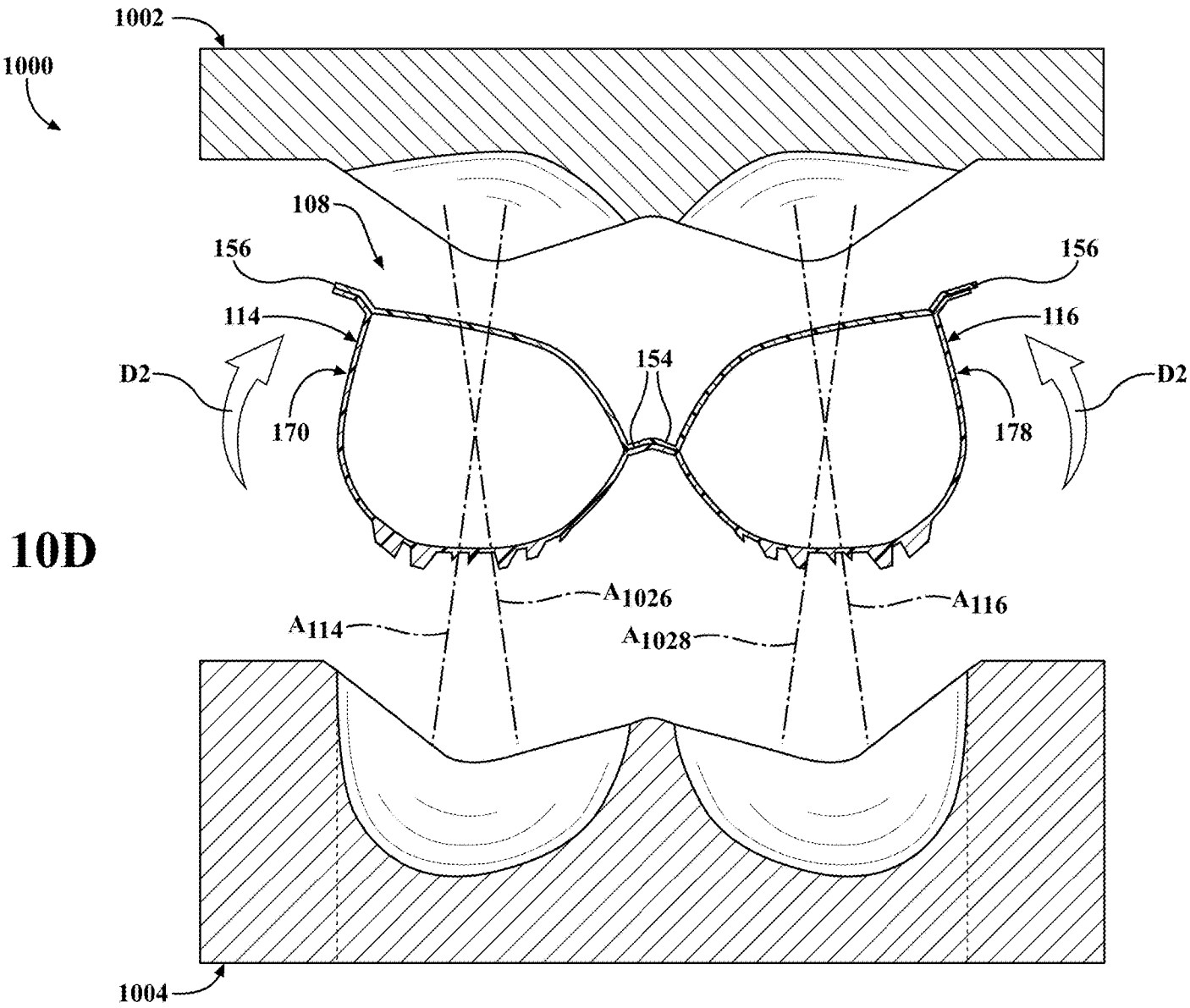

Once the bladders 110, 112 are formed within the mold cavity 1006, the mold system 1000 is opened and the cushioning arrangement 108 is lifted from the mold cavity 1006 in an upward direction D1. Here, the inward orientation of the chambers 114, 116 allows the cushioning arrangement 108 to be extracted from the mold cavity 1006 without obstruction by portion of the lower mold surface 1010 forming the lower mold cavities 1018*a*-1018*g*, 1020*a*-1020*g*. Upon extraction from the mold cavity 1006, the bladders 110, 112 may be separated from each other for installation on the chassis 106. As shown in FIG. 10D, the bladders 110, 112 are rotated in an outward direction D2 relative to the polar axes $A_{1026}$, $A_{1028}$ for installation into the chassis 106 such that the peripheral wall portions 170, 178 are distended.

The system 1000 and method of using the system 1000 to form the cushioning arrangement 108 disclosed herein advantageously allow the cushioning arrangement 108 to include distended chambers 114*a*-114*g*, 116*a*-116*g* that are oriented at oblique angles and project beyond an outer periphery of the footbed and the upper 200. The angled chambers 114*a*-114*g*, 116*a*-116*g* provide the sole structure 100 with an increased width to enhance stability along a lateral direction. Furthermore, orienting the walls of the chambers 114*a*-114*g*, 116*a*-116*g* at outward oblique angles allows lateral forces to be at least partially transmitted as axial forces (i.e., parallel to the walls) of the chambers 114*a*-114*g*, 116*a*-116*g* rather than as pure bending forces (i.e., transverse to the wall) to provide additional stability in the lateral direction. By forming the chamber cavities 1026, 1028 of the mold system 1000 at different angles than the angles of the assembled chambers 114*a*-114*g*, 116*a*-116*g*, the chamber cavities 1026, 1028 can be formed with positive draft angles to allow easy extraction of the chambers 114*a*-114*g*, 116*a*-116*g* from the mold system 1000.

The following Clauses provide exemplary configurations for an article of footwear, a bladder for an article of footwear, or a sole structure for an article of footwear as well as related methods for forming an article of footwear, a bladder for an article of footwear, or a sole structure for an article of footwear described above.

Clause 1. A sole structure for an article of footwear, the sole structure comprising a chassis including a first side defining a footbed and a second side disposed on an opposite side from the first side, a first bladder attached to the second side of the chassis and including at least one first chamber defining a first polar axis oriented in a first direction, and a second bladder attached to second side of the chassis and including at least one second chamber defining a second polar axis oriented in a second direction transverse to the first direction.

Clause 2. The sole structure of Clause 1, wherein the first direction is a first oblique angle oriented towards a lateral side of the sole structure and the second direction is a second oblique angle oriented towards a medial side of the sole structure.

Clause 3. The sole structure of any of the preceding Clauses, wherein the at least one first chamber is aligned with the at least one second chamber in a lateral direction of the sole structure.

Clause 4. The sole structure of any of the preceding Clauses, wherein the at least one first chamber and the at least one second chamber each have an ellipsoidal shape.

Clause 5. The sole structure of Clause 4, wherein the ellipsoidal shape is truncated.

Clause 6. The sole structure of any of the preceding Clauses, wherein the at least one first chamber includes a plurality of first chambers arranged along a lateral side of the sole structure and the at least one second chamber includes a plurality of second chambers arranged along a medial side of the sole structure, each of the first chambers oriented in the first direction and each of the second chambers oriented in the second direction.

Clause 7. The sole structure of any of the preceding Clauses, wherein the second side of the chassis includes at least one first socket attached to the at least one first chamber and at least one second socket attached to the at least one second chamber.

Clause 8. The sole structure of Clause 7, wherein the at least one first socket is oriented in the first direction and the at least one second socket is oriented in the second direction.

Clause 9. The sole structure of Clause 7, wherein the at least one first socket includes a first receptacle configured to receive the at least one first chamber and the at least one second socket includes a second receptacle configured to receive the at least one second chamber.

Clause 10. The sole structure of Clause 9, wherein the first receptacle defines a first concave surface and the second receptacle defines a second concave surface.

Clause 11. The sole structure of any of the preceding Clauses, wherein the first bladder and the second bladder are a unitary piece.

Clause 12. The sole structure of any one of Clauses 1-10, wherein the first bladder and the second bladder are separate from one another.

Clause 13. A sole structure for an article of footwear, the sole structure comprising a chassis including a top side defining a footbed and a bottom side disposed on an opposite side form the top side, a first bladder attached to the chassis at the bottom side and including at least one first chamber distended beyond the footbed on a first side of the sole structure, and a second bladder attached to the chassis at the bottom side and including at least one second chamber distended beyond the footbed on a second side of the sole structure.

Clause 14. The sole structure of Clause 13, wherein the at least one first chamber extends at a first oblique angle oriented towards the first side of the sole structure and the at least one second chamber extends at a second oblique angle oriented towards the second side of the sole structure.

Clause 15. The sole structure of any one of Clauses 13-14, wherein the at least one first chamber is aligned with the at least one second chamber in a lateral direction of the sole structure.

Clause 16. The sole structure of any one of Clauses 13-15, wherein the at least one first chamber and the at least one second chamber each have an ellipsoidal shape.

Clause 17. The sole structure of Clause 14, wherein the ellipsoidal shape is truncated.

Clause 18. The sole structure of any one of Clauses 13-17, wherein the at least one first chamber includes a plurality of first chambers arranged along a lateral side of the sole structure and the at least one second chamber includes a plurality of second chambers arranged along a medial side of the sole structure, each of the first chambers oriented in a first direction and each of the second chambers oriented in a second direction.

Clause 19. The sole structure of any one of Clauses 13-18, wherein the bottom side of the chassis includes at least one first socket attached to the at least one first chamber and at least one second socket attached to the at least one second chamber.

Clause 20. The sole structure of Clause 19, wherein the at least one first socket is oriented towards the first side of the sole structure and the at least one second socket is oriented towards the second side of the sole structure.

Clause 21. The sole structure of Clause 19, wherein the at least one first socket includes a first receptacle configured to receive the at least one first chamber and the second socket includes a second receptacle configured to receive the at least one second chamber.

Clause 22. The sole structure of Clause 21, wherein the first receptacle defines a first concave surface and the second receptacle defines a second concave surface.

Clause 23. The sole structure of any one of Clauses 13-22, wherein the first bladder and the second bladder are a unitary piece.

Clause 24. The sole structure of any one of Clauses 13-22, wherein the first bladder and the second bladder are separate from one another.

Clause 25. A method of forming a sole structure for an article of footwear, the method comprising inserting a barrier layer in a mold cavity of a mold assembly, the mold cavity defining at least one first chamber cavity oriented at a first angle and at least one second chamber cavity oriented at a second angle, biasing the barrier layer against a surface of the mold cavity to form a cushioning arrangement including at least one first chamber in the at least one first chamber cavity oriented at the first angle and at least one second chamber in the at least one second chamber cavity oriented at the second angle; extracting the cushioning arrangement from the mold cavity, rotating the first chamber in a first direction about a longitudinal axis of the cushioning arrangement to orient the first chamber at a third angle, and rotating the second chamber in a second direction about the longitudinal axis to orient the second chamber at a fourth angle transverse to the third angle.

Clause 26. The method of Clause 25, further comprising attaching the first chamber to a first socket of a chassis oriented at the third angle and attaching the second chamber to a second socket of the chassis oriented at the fourth angle.

Clause 27. The method of Clauses 25 or 26, wherein orienting the at least one first chamber at the third angle includes positioning a lower portion of the at least one first chamber outwardly from an upper portion of the first chamber relative to a longitudinal axis of the sole structure.

Clause 28. The method of any one of Clauses 25-27, wherein the at least one first chamber cavity includes a plurality of first chamber cavities and the at least one second chamber cavity includes a plurality of second chamber cavities.

Clause 29. The method of Clause 28, wherein biasing the barrier layer against the surface of the mold cavity includes providing a fluid to the plurality of first chamber cavities via a first inflation conduit and providing a fluid to the plurality of second chamber cavities via a second inflation conduit in parallel with the first inflation conduit.

Clause 30. The method of any one of Clauses 25-29, further comprising joining the barrier layers together at a first inflation port to seal the at least one first chamber and joining the barrier layers together at a second inflation port to seal the at least one second chamber in fluid isolation from the at least one first chamber.

Clause 31. The method of any one of Clauses 25-30, wherein the mold cavity defines a ridge disposed between the at least one first chamber cavity and the at least one second chamber cavity.

Clause 32. The method of Clause 31, wherein the ridge includes a first ridge surface adjacent to the at least one first chamber cavity and a second ridge surface adjacent to the at least one second chamber cavity, the first ridge surface being transverse to the second ridge surface.

Clause 33. The method of Clause 31, wherein a width of the ridge tapers between the first chamber cavity and the second chamber cavity.

Clause 34. The method of any one of Clauses 31-33, further comprising forming a gap between the at least one first chamber and the at least one second chamber using the ridge, and bending the at least one first chamber towards the at least one second chamber to reduce a width of the gap.

Clause 35. A mold system for forming a cushioning arrangement for an article of footwear, the system comprising at least one first chamber cavity oriented at a first angle, at least one second chamber cavity oriented at a second angle transverse to the first angle, an inflation manifold including a first inflation conduit in fluid communication with the at least one first chamber cavity and a second inflation conduit in fluid communication with the at least one second chamber cavity.

Clause 36. The system of Clause 35, wherein the at least one first chamber cavity includes a plurality of chamber cavities fluidly coupled along the first inflation conduit and the at least one second chamber cavity includes a plurality of second chamber cavities fluidly coupled along the second inflation conduit.

Clause 37. The system of Clauses 35 or 36, wherein the at least one first chamber cavity has a first ellipsoidal shape defining a first axis oriented at the first angle and the at least one second chamber cavity has a second ellipsoidal shape defining a second axis oriented at the second angle.

Clause 38. The system of Clause 37, wherein at least one of the first ellipsoidal shape or the second ellipsoidal shape is a truncated ellipsoidal shape.

Clause 39. The system of any one of Clauses 35-38, further comprising a ridge disposed between the at least one first chamber cavity and the at least one second chamber cavity.

Clause 40. The system of Clause 39, wherein the ridge includes a first ridge surface adjacent to the at least one first chamber cavity and a second ridge surface adjacent to the at least one second chamber cavity, the first ridge surface transverse to the second ridge surface.

Clause 41. The system of Clause 39, wherein a width of the ridge tapers between the first chamber cavity and the second chamber cavity.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a chassis extending across a width of the sole structure from a medial side to a lateral side and from a forefoot region to a heel region and including a first side defining a footbed and a second side disposed on an opposite side from the first side, the second side including a plurality of first receptacles aligned with one another along the medial side and a plurality of second receptacles aligned with one another along the lateral side;

a first bladder attached to the second side of the chassis and including a plurality of first chambers arranged along a medial side edge of the sole structure, at least one first chamber of the plurality of first chambers extending beyond a longitudinal axis of the article of footwear, the plurality of first chambers each including a generally hemispherical first upper chamber wall that is matingly received by a respective first receptacle of the plurality of first receptacles; and a second bladder attached to the second side of the chassis and including a plurality of second chambers arranged along the lateral side of the sole structure, the plurality of second chambers each including a generally hemispherical second upper chamber wall that is matingly received by a respective second receptacle of the plurality of second receptacles.

2. The sole structure of claim 1, wherein first chambers of the plurality of first chambers are aligned with respective second chambers of the plurality of second chambers in a lateral direction of the sole structure.

3. The sole structure of claim 1, wherein at least one first chamber of the plurality of first chambers is elongate and extends along a first longitudinal axis and at least one second chamber of the plurality of second chambers is elongate and extends along a second longitudinal axis.

4. The sole structure of claim 3, wherein the first longitudinal axis is substantially aligned with the second longitudinal axis across a width of the sole structure.

5. The sole structure of claim 1, wherein at least one first chamber of the plurality of first chambers and at least one second chamber of the plurality of second chambers has an ellipsoidal shape.

6. The sole structure of claim 5, wherein the ellipsoidal shape is truncated.

7. The sole structure of claim 1, wherein at least one first chamber of the plurality of first chambers includes at least one of a different size and a different shape than other first chambers of the plurality of first chambers and at least one second chamber of the plurality of second chambers includes at least one of a different size and a different shape than other second chambers of the plurality of second chambers.

8. The sole structure of claim 1, wherein first receptacles of the plurality of first receptacles define a first concave surface receiving the generally hemispherical first upper chamber wall of respective first chambers of the plurality of first chambers and second receptacles of the plurality of second receptacles define a second concave surface receiving the generally hemispherical second upper chamber wall of respective second chambers of the plurality of second chambers.

9. The sole structure of claim 1, wherein the chassis further comprises a plurality of ribs extending along the second side of the chassis between adjacent receptacles to provide longitudinal stiffness.

10. An article of footwear incorporating the sole structure of claim 1.

11. A sole structure for an article of footwear, the sole structure comprising:

a chassis extending across a width of the sole structure from a medial side to a lateral side and from a forefoot region to a heel region and including a first side defining a footbed and a second side disposed on an opposite side from the first side, the second side including a plurality of first concave receptacles and a plurality of second concave receptacles;

a first bladder attached to the second side of the chassis and including a plurality of first chambers arranged along a medial side edge of the sole structure, at least one first chamber of the plurality of first chambers extending beyond a longitudinal axis of the article of footwear, the plurality of first chambers each including a generally hemispherical first upper chamber wall that is received by a respective first concave receptacle of the plurality of first concave receptacles; and a second bladder attached to the second side of the chassis and including a plurality of second chambers arranged along the lateral side of the sole structure, the plurality of second chambers each including a generally hemispherical second upper chamber wall that is received by a respective second concave receptacle of the plurality of second concave receptacles.

12. The sole structure of claim 11, wherein first chambers of the plurality of first chambers are aligned with respective second chambers of the plurality of second chambers in a lateral direction of the sole structure.

13. The sole structure of claim 11, wherein at least one first chamber of the plurality of first chambers is elongate and extends along a first longitudinal axis and at least one second chamber of the plurality of second chambers is elongate and extends along a second longitudinal axis.

14. The sole structure of claim 13, wherein the first longitudinal axis is substantially aligned with the second longitudinal axis across a width of the sole structure.

15. The sole structure of claim 11, wherein at least one first chamber of the plurality of first chambers and at least one second chamber of the plurality of second chambers has an ellipsoidal shape.

16. The sole structure of claim 15, wherein the ellipsoidal shape is truncated.

17. The sole structure of claim 11, wherein at least one first chamber of the plurality of first chambers includes at least one of a different size and a different shape than other first chambers of the plurality of first chambers and at least one second chamber of the plurality of second chambers includes at least one of a different size and a different shape than other second chambers of the plurality of second chambers.

18. The sole structure of claim 11, wherein first concave receptacles of the plurality of first concave receptacles matingly receive the generally hemispherical first upper chamber wall of respective first chambers of the plurality of first chambers and second concave receptacles of the plurality of second concave receptacles matingly receive the generally hemispherical second upper chamber wall of respective second chambers of the plurality of second chambers.

19. The sole structure of claim 11, wherein the chassis further comprises a plurality of ribs extending along the second side of the chassis between adjacent receptacles to provide longitudinal stiffness.

20. An article of footwear incorporating the sole structure of claim 11.

* * * * *